United States Patent [19]

Parton et al.

[11] Patent Number: 4,459,347

[45] Date of Patent: Jul. 10, 1984

[54] ADSORBABLE ARYLHYDRAZIDES AND APPLICATIONS THEREOF TO SILVER HALIDE PHOTOGRAPHY

[75] Inventors: Richard L. Parton, Webster; James A. Friday, Rochester, both of N.Y.

[73] Assignee: Eastman Kodak Company, Rochester, N.Y.

[21] Appl. No.: 493,554

[22] Filed: May 11, 1983

[51] Int. Cl.[3] ..... G03C 1/28; G03C 1/36

[52] U.S. Cl. ..... 430/217; 430/603; 430/605; 430/598; 430/542; 564/74

[58] Field of Search ..... 430/603, 605, 598, 217, 430/542; 564/74

[56] References Cited

U.S. PATENT DOCUMENTS

| | | |
|---|---|---|
| 2,419,975 | 5/1947 | Trivelli . |
| 2,563,785 | 8/1951 | Ives . |
| 3,227,552 | 1/1966 | Whitmore . |
| 4,030,925 | 6/1977 | Leone et al. . |
| 4,031,127 | 6/1977 | Leone et al. . |
| 4,080,207 | 3/1978 | Leone et al. . |
| 4,168,977 | 9/1979 | Takada et al. . |
| 4,224,401 | 9/1980 | Takada et al. . |
| 4,243,739 | 1/1981 | Mifune et al. . |
| 4,245,037 | 1/1981 | Tsujino et al. . |
| 4,255,511 | 3/1981 | Hirano et al. . |
| 4,266,013 | 5/1981 | Adachi et al. . |
| 4,269,929 | 5/1981 | Nothnagle . |
| 4,272,614 | 6/1981 | Mifune et al. . |
| 4,276,364 | 6/1981 | Leone . |
| 4,323,643 | 4/1982 | Mifune et al. . |

OTHER PUBLICATIONS

*Research Disclosure*, vol. 151, Nov. 1976, Item 15162.
*Research Disclosure*, vol. 176, Dec. 1978, Item 17626.

*Primary Examiner*—Won H. Louie, Jr.
*Attorney, Agent, or Firm*—Carl O. Thomas

[57] ABSTRACT

The use of oxythioamido substituted arylhydrazides in producing images in silver halide photographic elements is disclosed. The oxythioamido substituted arylhydrazide can be incorporated in photographic silver halide emulsions. The oxythioamido substituent is capable of promoting adsorption of the arylhydrazide to silver halide grain surfaces. In negative working surface latent image forming emulsions the oxythioamido substituted arylhydrazides permit higher speeds to be achieved. In direct positive internal latent image forming emulsions increased nucleation activity can be achieved.

34 Claims, No Drawings

ADSORBABLE ARYLHYDRAZIDES AND APPLICATIONS THEREOF TO SILVER HALIDE PHOTOGRAPHY

FIELD OF THE INVENTION

This invention is directed to novel arylhydrazides and to silver halide emulsions and photographic elements in which they are incorporated. The invention is applicable to negative working surface latent image forming silver halide emulsions and to direct positive silver halide emulsions which form internal latent images.

BACKGROUND OF THE INVENTION

Hydrazines find a variety of uses in silver halide photography. They have been used in negative working surface latent image forming silver halide emulsions to increase speed and/or contrast. They have been used as nucleating agents in internal latent image forming direct positive emulsions as nucleating agents.

The use of hydrazines in negative working surface latent image forming emulsions to increase speed and contrast is taught by Trivelli et al U.S. Pat. No. 2,419,975. Increased contrast attributable to hydrazines in negative working surface latent image forming emulsions is believed to result from the promotion of infectious development.

Direct positive images can be produced using internal latent image forming emulsions by uniformly exposing the emulsions to light during development. This renders selectively developable the emulsion grains which were not imagewise exposed—that is, those grains which do not contain an internal latent image. Ives U.S. Pat. No. 2,563,785 recognized that the presence of hydrazines during processing can obviate the need for uniform light exposure. Hydrazines so employed with internal latent image forming direct positive emulsions are commonly referred to as nucleating agents (sometimes shortened to "nucleators"). Occasionally the term "fogging agent" is employed, but the term "nucleating agent" is preferred, since nucleating agents do not produce indiscriminate fogging.

The most efficient hydrazines employed in silver halide photographic systems employ a combination of substituents to balance activity and stability. The stability of hydrazines is increased by attaching directly to one of the nitrogen atoms a tertiary carbon atom, such as the carbon atom of an aromatic ring. The art has long recognized that the activity of these stabilized hydrazines can be increased by the direct attachment of an acyl group to the remaining nitrogen atom. Thus, the most commonly employed hydrazines are arylhydrazides.

Arylhydrazides can be incorporated in processing solutions or, preferably, can be introduced directly into photographic elements. Mobile arylhydrazides are preferred for use in processing solutions, but when incorporated in photographic elements the mobility of the arylhydrazides is preferably reduced. This can be achieved by incorporating a ballast. It is also known to incorporate moieties for promoting adsorption to silver halide grain surfaces. When an efficient adsorption promoting moiety is incorporated in an arylhydrazide, the molar concentration of the arylhydrazide can often be reduced by an order of magnitude without loss of activity. Absorbable arylhydrazides are particularly preferred for increasing the speed of negative working silver halide emulsions and nucleation in direct positive emulsions. However, tightly adsorbable arylhydrazides are not usually efficient in increasing the contrast of negative working silver halide emulsions. It is believed that contrast is increased by infectious development and that undue restriction of mobility interferes with the ability of the arylhydrazide to promote infectious development.

The following U.S. Pat. Nos. and other references are illustrative of mobile, ballasted, and adsorbable arylhydrazides employed in processing solutions and incorporated in both negative working and direct positive photographic elements:

P-1 Whitmore: 3,227,552
P-2 Leone et al: 4,030,925
P-3 Leone et al: 4,031,127
P-4 Leone et al: 4,080,207
P-5 Takada et al: 4,168,977
P-6 Takada et al: 4,224,401
P-7 Tsujino et al: 4,245,037
P-8 Hirano et al: 4,255,511
P-9 Adachi et al: 4,266,013
P-10 Nothnagle: 4,269,929
P-11 Mifune et al: 4,243,739
P-12 Mifune et al: 4,272,614
P-13 Leone: 4,276,364
P-14 Mifune et al: 4,323,643
RD-1 *Research Disclosure,* Vol. 151, November 1976, Item 15162. (Note reduction sensitization effect, left column, page 77.)
RD-2 Sidhu et al, *Research Disclosure,* Vol. 176, December 1978, Item 17626.
(*Research Disclosure* and *Product Licensing Index* were publications of Industrial Opportunities Ltd.; Homewell, Havant; Hampshire, P09 1EF, United Kingdom. *Research Disclosure* is now published at Emsworth Studios, 535 West End Avenue, New York, New York 10024.)

Although adsorption promoting moieties for arylhydrazides can include heterocyclic ring structures, such as nuclei of cyanine and merocyanine spectral sensitizing dyes, as illustrated by P-4 and RD-2, preferred adsorption promoting moieties are acyclic thioamido moieties—i.e., moieties containing the following grouping:

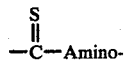

where the thiocarbonyl, —C(S)—, and Amino groups are not part of a ring structure. Particularly preferred thioamido adsorption promoting moieties are acyclic thioureas, such as those illustrated by P-2, P-3, P-8, P-11, and P-13. P-11, which is directed to achieving high contrast, also discloses the use of acyclic thioamido moieties of the following structures:

(II) (III)

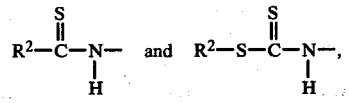

where $R^2$ is an alkyl substituent (including alkyl and substituted alkyl groups).

SUMMARY OF THE INVENTION

The present invention relates to photographically useful arylhydrazides containing an acyclic oxythioamido moiety for promoting adsorption to silver halide grain surfaces of the formula $$-O-\overset{\overset{\displaystyle S}{\|}}{C}-\text{Amino-} \qquad \text{(IV)}$$

where Amino is a secondary or tertiary amino group, provided that Amino is a secondary amino group when —O— and Amino are both directly bonded to aromatic rings.

The invention is also directed to radiation-sensitive silver halide emulsions containing these arylhydrazides adsorbed to silver halide grain surfaces and to photographic elements containing these emulsions.

It has been observed that an increase in activity in arylhydrazides having an acyclic oxythioamido moiety is achieved when the thiocarbonyl group is linked directly to an oxygen atom as compared to a divalent sulfur atom. When employed with negative working surface latent image forming silver halide emulsions, the arylhydrazides of this invention can increase speed. When employed with direct positive internal latent image forming silver halide emulsions, the arylhydrazides of this invention can increase nucleating activity.

DESCRIPTION OF PREFERRED EMBODIMENTS

The arylhydrazides of this invention are those which contain an acyclic oxythioamido moiety, such as described above in connection with formula IV, for promoting adsorption to silver halide grain surfaces. Moieties satisfying formula IV are hereinafter also referred to as oxythioamido moieties. The structure of the oxythioamido moiety containing arylhydrazides can be directly analogous to arylhydrazides known to have photographic utility containing a thioureido adsorption promoting moiety or an adsorption promoting moiety as illustrated by formula III, hereinafter referred to as a dithioamido moiety. Thus arylhydrazides according to this invention can be similar to the thioureidoarylhydrazides of patents P-2, P-3, P-8, P-11, and P-13 and the dithioamidoarylhydrazides of patent P-11, each cited above and here incorporated by reference, except that an oxygen atom is substituted for one of the nitrogen atoms of the thioureido moieties or an oxygen atom is substituted for the divalent sulfur atom linked to the thiocarbonyl moiety in the dithioamido moieties. The oxythioamido moiety can be linked to the arylhydrazide moiety either through the —O— or —Amino— group of formula IV or through both. In the latter case the arylhydrazides are analogous to the bis(arylhydrazide)-thioureas disclosed by P-2 and P-3.

The linkage between the arylhydrazide moiety and the oxythioamido moiety can be by direct bonding or through an intervening divalent linking group, such as illustrated by P-8, P-11, and RD-2. Both P-8 and P-11 show the adsorption promoting moiety linked to an aromatic ring which is attached through a divalent linkage to the aryl group of the arylhydrazide. RD-2, cited above and here incorporated by reference, discloses adsorption promoting moieties linked to the aryl group of arylhydrazides through aliphatic divalent linking groups as well as those containing aromatic rings. Thus, appropriate divalent linking groups can be selected from among a variety of such groups known to the art.

To avoid loss of activity, when —O— and —Amino— in formula IV are both bonded directly to aromatic rings, —Amino— can only be a secondary amino group. In other words, in accordance with the accepted definition of secondary amine, the nitrogen atom of the amino group must be bonded to one hydrogen atom when the amino nitrogen atom is bonded directly to an aromatic ring and —O— is also bonded directly to an aromatic ring. As shown below, failure to satisfy this requirement results in loss of activity.

The arylhydrazide is most commonly attached to an adsorption promoting moiety through its aryl group. The oxythioamido adsorption promoting moiety can be attached through either its oxygen atom or amide nitrogen atom, with the latter being preferred. Thus, in a preferred form arylhydrazides of this invention can be represented by the formula:

$$\text{Oxy}-\overset{\overset{\displaystyle S}{\|}}{C}-\text{Amino-}(\text{Ar}_m-\text{L})_n-\text{Ar}^1-\text{Hyd}-\text{Acyl} \qquad \text{(V)}$$

where

Oxy is an oxy group;

Amino is a secondary or tertiary amino group;

Ar and $Ar^1$ are arylene groups;

L is a divalent aliphatic linking group;

m and n are 0 or 1;

Hyd is N,N'-hydrazino (i.e., hydrazo); and

Acyl is an acyl group;

with the proviso that Amino is a secondary amino group when Oxy is an aryloxy group and Amino is bonded directly to Ar or $Ar^1$.

In formula V or in other forms of the arylhydrazides of this invention discussed above the oxy group can take the form $$R-O-$$

where R can be a hydrogen atom, an aliphatic residue, or an aromatic residue. While the oxy group can be a hydroxy group, it is generally preferred that R be an alkyl substituent or an aryl group.

When R is an alkyl substituent, it can consist of alkyl or a variety of substituted alkyl groups. Generally the alkyl substituents can be chosen from among any of those bonded to the nitrogen atoms of thioureido adsorption promoting moieties. For example, the alkyl substituent can be include substituents such as alkoxyalkyl, haloalkyl (including perhaloalkyl—e.g., trifluoromethyl and homologues), and aralkyl (e.g., phenylalkyl or naphthylalkyl) substituents as well as alkyl (i.e., unsubstituted alkyl). Although the number of carbon atoms can be varied widely, commonly the alkyl substituent contains from about 1 to 18 carbon atoms, with individual alkyl moieties typically having from about 1 to 8 carbon atoms. In a specifically preferred form the entire alkyl substituent contains from 1 to 8 carbon atoms.

R can alternatively take the form of a aryl group. The term "aryl" is employed in its art recognized sense as the organic radical formed by the removal of one pendant atom directly bonded to a ring carbon atom of an aromatic nucleus. The aromatic nucleus can be comprised of a carbocyclic aromatic ring, such as a separate or fused benzene ring (e.g., a phenyl or naphthyl group), or a heterocyclic ring (e.g., a pyridyl, furyl, pyrrolyl, or thiyl group). The aromatic nucleus can include ring substituents, such as alkyl, alkoxy, halo, cyano, or haloalkyl. Generally preferred aryl groups are phenyl substituents, including both phenyl and substituted phenyl. The aryl groups bonded directly to nitrogen atoms of thioueido adsorption promoting moieties of conventional arylhdyrazides can be employed. Generally the aryl groups contain 18 or fewer carbon atoms.

While generally adsorption to silver halide grain surfaces is sufficient in itself to impart the desired immobility to the oxythioamidoarylhydrazide, it is appreciated that advantages in specific applications can be realized by relying also on R as a ballasting group. When R is being relied upon for ballasting, it can usually be selected to include any of the common ballasting groups for photographic addenda, such as for example those known to be useful in incorporated dye image providing couplers. Commonly the number of carbon atoms in ballasting substituents ranges from about 8 to 30 or more carbon atoms.

Amino in formula IV can take the form of a secondary or tertiary amino group. That is, it can take the following form:

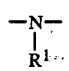

(VI)

where $R^1$ is hydrogen when Amino is a secondary amino group and $R^1$ can otherwise take any convenient conventional form. $R^1$ can, for example, take the form of any nitrogen atom substituent of a thioureido adsorption promoting moiety. When the oxythioamido adsorption promoting moiety is bonded to the arylhydrazide through the oxy (—O—) linkage, Amino can take the following form:

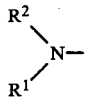

(VII)

where $R^1$ is as described above and $R^2$ can be similarly, though independently chosen, provided that both $R^1$ and $R^2$ are not hydrogen atoms (otherwise the amino group would be a primary amino group). Suitable substituents are illustrated by P-2, P-3, and P-13, cited above and here incorporated by reference. Specifically preferred forms of $R^1$ and $R^2$ correspond to specifically preferred forms of R described above with generally similar considerations applying.

In formula V when Amino is directly linked to an aromatic ring and Oxy is an aryloxy group, then Amino is secondary amino and $R^1$ in formula VI must be hydrogen. When Amino is directly linked to an aromatic ring, but Oxy is not an aryloxy group, then Amino can be also a tertiary amino group, but for synthetic convenience $R^1$ in formula VI in this instance is preferably a hydrogen atom or a benzyl substituent, such as benzyl, alkylbenzyl, alkoxybenzyl or halobenzyl. The alkyl moieties in the benzyl substituent preferably contain from 1 to 8 carbon atoms.

By proper choice of groups bonded to the structure of formula IV it is possible to produce oxythioamido substituted arylhydrazides which either increase or decrease in activity as processing temperature is increased. While processing temperatures can be controlled precisely in many photographic applications, this can be inconvenient in many instances and impossible to others. In image transfer photography processing frequently occurs at approximately the ambient temperature of the scene being photographed. Thus, being able to control activity as a function of processing temperature constitutes a significant advantage of the present invention.

By choosing oxythioamido substituents according to their electron withdrawing or electron donating characteristics it is possible to control the activity of the arylhydrazide as a function of processing temperature. It is specifically contemplated to employ a single oxythioamido substituted arylhydrazide wherein the oxythioamido moiety is properly substituted with electron withdrawing and/or electron donating groups to achieve the desired correspondence of activity and processing temperature. It is also contemplated to employ a single oxythioamido substituted arylhydrazide in combination with another conventional arylhydrazide (or functionally equivalent conventional compound) so that the two compounds in combination provide the desired correspondence between activity and processing temperature. Alternatively two different oxthioamido substituted arylhydrazides differing in activity as a function of temperature can be employed in combination. For example, it is specifically contemplated to employ an oxythioamido substituted arylhydrazide according to this invention which increases in activity with increasing processing temperatures in combination with an oxythioamido substituted arylhydrazide according to this invention which decreases in activity with increasing processing temperatures. Thus, in combination an overall balance of activity over a range of processing temperatures is permitted which neither oxythioamido substituted arylhydrazide can achieve alone and which might otherwise be difficult to achieve with a single arylhydrazide of a desired level of activity.

Selection of substituents according to their electron withdrawing or electron donating characteristics is within the ordinary skill of the art. Unsubstituted phenyl groups are essentially neutral, neither significantly electron withdrawing nor electron donating. However, phenyl rings can become either electron withdrawing or electron donating when substituted. The effect of various substituents on electron withdrawing and donating properties of phenyl rings has been quantified in terms of published Hammett sigma values, which are assigned based on the substituent and its ring position. The net effect of substituent combinations can be quantitatively determined by algebraically adding Hammet sigma values of individual substituents. Published Hammett sigma values can provide a guide for selecting electron withdrawing and electron donating substituents.

Exemplary meta- and para-sigma values and procedures for their determination are set forth by J. Hine in *Physical Organic Chemistry,* second edition, page 87, published in 1962; H. VanBekkum, P. E. Verkade and B. M. Wepster in *Rec. Trav. Chim.,* Volume 78, page 815, published in 1959; P. R. Wells in *Chem Revs.,* Vol. 63, p. 171, published in 1963, by H. H. Jaffe in *Chem. Revs.,* Vol. 53, p. 191, published 1953; by M. J. S. Dewar and P. J. Grisdale in *J. Amer. Chem. Soc.,* Vol. 84, p.

3548, published in 1962, and by Barlin and Perrin in *Quart. Revs.*, Vol. 20, p. 75 et seq., published in 1966.

The remaining portion of formula V—that is the following structure:

$$-(Ar_m-L)_n-Ar^1-Hyd-Acyl$$

can be collectively referred to as an arylhydrazide moiety. The arylhydrazide moiety can take any of the conventional forms described in P-1 through P-14, RD-1, and RD-2, cited above and here incorporated by reference. Thus, detailed description of the arylhydrazide moiety is considered unnecessary. However, the arylhydrazide moiety has been articulated by components in formula V to permit preferred components to be specifically identified and discussed.

P-8 and P-11, cited above, illustrate arylhydrazide moieties in which m and n are both 1. RD-2 further illustrates arylhydrazide moieties in which m is 0 and n is 1. In general preferred arylhydrazide moieties are those in which n is 0—that is, in which a single aromatic ring joins the adsorption promoting moiety to the hydrazino moiety (—Hyd—). Ar and $Ar^1$ each can take the form of any useful arylene nucleus. The term "arylene" is defined as the organic radical formed by the removal of two pendant atoms each directly bonded to a different ring carbon atom of an aromatic nucleus. Ar and $Ar^1$ can take any of the forms described above of the aryl group, differing only in being divalent. Ar and $Ar^1$ are preferably phenylene or naphthalene. Divalent phenylene groups are particularly preferred, most preferably p-phenylene, although ortho, meta, and paraphenylene groups have all been shown in the art to be useful.

The —Hyd— moiety is an —N,N'—hydrazino moiety. The hydrazino moiety can take the form:

$$-\overset{R^3}{\underset{}{N}}-\underset{R^4}{N}- \qquad \text{(VIII)}$$

where $R^3$ and $R^4$ are both hydrogen.

Alternatively, one of $R^3$ and $R^4$ can be an activating substituent, as taught by Hess et al U.S. Ser. No. 493,480, filed concurrently herewith and commonly assigned, titled THE APPLICATION OF ACTIVATED ARYLHYDRAZIDES TO SILVER HALIDE PHOTOGRAPHY. Preferred activating substituents are sulfinic acid radical substituents, such as an arylsulfonyl substituent. The arylsulfonyl substituent can be represented by the following:

$$O=\underset{Ar^2}{S}=O \qquad \text{(IX)}$$

wherein $Ar^2$ is an aryl moiety, as defined above. The aromatic nucleus $Ar^2$ can be chosen from the same aromatic nuclei described in connection with R above.

In a preferred form Acyl can be represented as by the following formula:

$$-\overset{O}{\overset{\|}{C}}-R^5 \qquad \text{(X)}$$

where $R^5$ is hydrogen or an aliphatic or aromatic residue. A particularly preferred acyl group is formyl, in which instance $R^5$ is hydrogen. Specifically preferred aliphatic residues are alkyl and alkoxy, most preferably those of from about 1 to 8 carbon atoms, optimally 1 to 4 carbon atoms. Specifically preferred aromatic residues are phenyl and naphthyl. Either electron withdrawing or electron donating substituents of the aromatic ring and alkyl moieties are contemplated with the former being preferred. Highly electron donating substituents can reduce activity. Alkyl, alkoxy, cyano, halo, or haloalkyl moieties are preferred aromatic ring and alkyl moiety substituents. The acyl group preferably contains less than 10, most preferably less than 8, carbon atoms.

The synthesis of specific oxythioamido substituted arylhydrazides is taught in the Examples.

One illustrative method for preparing oxythioamido substituted arylhydrazides in which R is an alkyl substituent can be represented by the following formula:

$$A-NCS + Alkyl\text{-}OH \longrightarrow Alkyl\text{-}O-\overset{S}{\overset{\|}{C}}-\underset{H}{N}-A \qquad \text{(XI)}$$

where

A is arylhydrazide and

Alkyl is an alkyl substituent.

The reaction is driven by heating to reflux.

Another, more general method of preparing oxythioamido substituted arylhydrazides can be represented by the following formula:

$$A-\underset{R^1}{N}-H + Cl-\overset{S}{\overset{\|}{C}}-OR \longrightarrow R-O-\overset{S}{\overset{\|}{C}}-\underset{R^1}{N}-A \qquad \text{(XII)}$$

where

A is arylhydrazide and

R and R' are as previously defined.

The reaction proceeds at room temperature in the presence of a base, such as pyridine.

The following are illustrative of specific preferred oxythioamido substituted arylhydrazides useful in the practice of this invention:

TABLE I $$R-E-\overset{S}{\overset{\|}{C}}-N-A$$

| Compound | E | R | $R^1$ | A |
|---|---|---|---|---|
| A | —O— | $C_2H_5$— | H | —$C_6H_4$—NHNHCHO |
| B | —O— | $CH_3$— | H | —$C_6H_4$—NHNHCHO |
| C | —O— | $C_2H_5$— | H | —$C_6H_4$—NHNHCOCH$_3$ |

TABLE I-continued $$R-E-\overset{\overset{\displaystyle S}{\|}}{C}-N-A$$

| Compound | E | R | $R^1$ | A |
|---|---|---|---|---|
| D | —O— | $C_2H_5$— | H | —$C_6H_4$—NHNHCO— 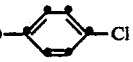 —Cl |
| E | —O— | $C_6H_5$— | H | —$C_6H_4$—NHNHCHO |
| F | —O— | $CH_3O$— 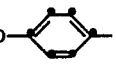 | H | —$C_6H_4$—NHNHCHO |
| G | —O— | Cl— 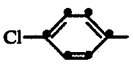 | H | —$C_6H_4$—NHNHCHO |
| H* | —O— | $C_6H_5$— | 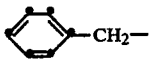 —$CH_2$— | —$C_6H_4$—NHNHCHO |
| I* | —O— | $CH_3O$— 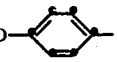 | 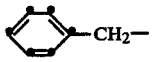 —$CH_2$— | —$C_6H_4$—NHNHCHO |
| J* | —O— | Cl— 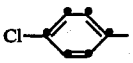 | 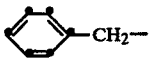 —$CH_2$— | —$C_6H_4$—NHNHCHO |
| K | —O— | $C_2H_5$— | 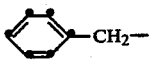 —$CH_2$— | —$C_6H_4$—NHNHCHO |
| L* | —S— | $C_6H_5$— | H | —$C_6H_4$—NHNHCHO |

*These compounds do not form a part of the invention, but are listed to show the structural similarity of compounds of inferior activity.

Advantages in photographic performance can be realized by using the oxythioamido substituted arylhydrazides described above so that they are present during development using an aqueous alkaline processing solution with radiation sensitive silver halide emulsions which form latent images either on their surface or internally by the photoelectron reduction of silver ions to silver atoms. Thus, apart from a few specialized silver halide photographic systems, such as photobleach reversal systems and those systems which require dry processing, the oxythioamido substituted arylhydrazides are generally useful with silver halide photographic systems. Such systems and their component features are generally disclosed in *Research Disclosure,* Vol. 176, December 1978, Item 17643, here incorporated by reference.

It is specifically contemplated that the oxythioamido substituted arylhydrazides of the present invention can be employed alone or in combination with conventional similarly useful quaternary ammonium salts, hydrazines, hydrazides, and hydrazones, such as those illustrated by U.S. Patents P-1 through P-14, RD-1, and RD-2, cited above to illustrate known arylhydazides, Adachi et al U.S. Pat. No. 4,115,122, Lincoln et al U.S. Pat. Nos. 3,615,615 and 3,854,956, Kurtz et al U.S. Pat. Nos. 3,719,494 and 3,734,738, von Konig et al U.S. Pat. No. 4,139,387, Baralle et al U.S. Pat. Nos. 4,306,016, 4,306,017, and 4,315,986, and U.K. Pat. Nos. 2,011,391, 2,012,443, and 2,087,057. These compounds can be employed in any photographically useful concentration, such as in previously taught concentrations, typically up to $10^{-2}$ mole per mole of silver.

These compounds can be incorporated in the silver halide emulsion by conventional procedures for incorporating photographic addenda, such as those set forth in *Research Disclosure,* Item 17643, cited above, Section XIV, here incorporated by reference. Where the compound is to be adsorbed to the surface of the silver halide grains, as is the case with the oxythioamido substituted arylhydrazides of this invention, it can be adsorbed using the procedures well known to those skilled in the art for adsorbing sensitizing dyes, such as cyanine and merocyanine dyes, to the surface of silver halide grains. While it is preferred to incorporate the oxythioamido substituted hydrazides directly in the silver halide emulsions prior to coating to form a photographic element, it is recognized that the hydrazides are effective if incorporated at any time before development of an imagewise exposed photographic element.

Preferred silver halide emulsions and photographic elements incorporating the oxythioamido substituted arylhydrazides of this invention are illustrated by two differing photographic systems discussed below.

Direct Positive Imaging

Photographic elements which produce images having an optical density directly related to the radiation received on exposure are said to be negative working. A positive photographic image can be formed by producing a negative photographic image and then forming a second photographic image which is a negative of the first negative, that is, a positive image. A direct positive image is understood in photography to be a positive image that is formed without first forming a negative image. Positive dye images which are not direct positive images are commonly produced in color photography by reversal processing in which a negative silver image is formed and a complementary positive dye image is then formed in the same photographic element. The term "direct reversal" has been applied to direct positive photographic elements and processing which produces a positive dye image without forming a negative silver image. Direct positive photography in general and direct reversal photography in particular are advantageous in providing a more straightforward approach to obtaining positive photographic images.

The oxythioamido substituted arylhydrazides can be employed as nucleating agents with any conventional photographic element capable of forming a direct positive image containing, coated on a photographic support, at least one silver halide emulsion layer containing a vehicle and silver halide grains capable of forming an internal latent image upon exposure to actinic radiation. As employed herein, the terms "internal latent image silver halide grains" and "silver halide grains capable of forming an internal latent image" are employed in the art-recognized sense of designating silver halide grains which produce substantially higher optical densities when coated, imagewise exposed, and developed in an internal developer than when comparably coated, exposed and developed in a surface developer. Preferred internal latent image silver halide grains are those which, when examined according to normal photographic testing techniques, by coating a test portion on a photographic support (e.g., at a coverage of from 3 to 4 grams per square meter), exposing to a light intensity scale (e.g., with a 500-watt tungsten lamp at a distance of 61 cm) for a fixed time (e.g., between $1\times10^{-2}$ and 1 second) and developing for 5 minutes at 25° C. in Kodak Developer DK-50 (a surface developer), provide a density of at least 0.5 less than when this testing procedure is repeated, substituting for the surface developer Kodak Developer DK-50 containing 0.5 gram per liter of potassium iodide (an internal developer). The internal latent image silver halide grains most preferred for use in the practice of this invention are those which, when tested using an internal developer and a surface developer as indicated above, produce an optical density with the internal developer at least 5 times that produced by the surface developer. It is additionally preferred that the internal latent image silver halide grains produce an optical density of less than 0.4 and, most preferably, less than 0.25 when coated, exposed and developed in surface developer as indicated above, that is, the silver halide grains are preferably initially substantially unfogged and free of latent image on their surface.

The surface developer referred to herein as Kodak Developer DK-50 is described in the *Handbook of Chemistry and Physics,* 30th edition, 1947, Chemical Rubber Publishing Company, Cleveland, Ohio, page 2558, and has the following composition:

| | |
|---|---|
| Water, about 125° F. (52° C.) | 500.0 cc |
| N—methyl-p-aminophenol hemisulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter. |

Internal latent image silver halide grains which can be employed in the practice of this invention are well known in the art. Patents teaching the use of internal latent image silver halide grains in photographic emulsions and elements include Davey et al U.S. Pat. No. 2,592,250, Porter et al U.S. Pat. No. 3,206,313, Milton U.S. Pat. No. 3,761,266, Ridgway U.S. Pat. No. 3,586,505, Gilman et al U.S. Pat. No. 3,772,030, Gilman et al U.S. Pat. No. 3,761,267, and Evans U.S. Pat. No. 3,761,276, the disclosures of which are hereby incorporated by reference.

It is specifically preferred to employ high aspect ratio tabular grain internal latent image forming emulsions. Such emulsions are the specific subject matter of Evans et al U.S. Ser. No. 431,912, filed Sept. 30, 1982, now abandoned in favor of U.S. Ser. No. 564,976, filed Nov. 12, 1983, commonly assigned, titled DIRECT REVERSAL EMULSIONS AND PHOTOGRAPHIC ELEMENTS USEFUL IN IMAGE TRANSFER FILM UNITS. These emulsions are also disclosed in *Research Disclosure,* Vol. 225, January 1983, Item 22534.

The internal latent image silver halide grains preferably contain bromide as the predominant halide. The silver bromide grains can consist essentially of silver bromide or can contain silver bromoiodide, silver chlorobromide, silver chlorobromoiodide crystals and mixtures thereof. Internal latent image forming sites can be incorporated into the grains by either physical or chemical internal sensitization. Davey et al, cited above, for example, teaches the physical formation of internal latent image forming sites by the halide conversion technique. Chemical formation of internal latent image forming sites can be produced through the use of sulfur, gold, selenium, tellurium and/or reduction sensitizers of the type described, for example, in Sheppard et al U.S. Pat. No. 1,623,499, Waller et al U.S. Pat. No. 2,399,083, McVeigh U.S. Pat. No. 3,297,447, and Dunn U.S. Pat. No. 3,297,446, as taught in the patents cited in the preceding paragraph. Internal latent image sites can also be formed through the incorporation of metal dopants, particularly Group VIII noble metals, such as, ruthenium, rhodium, palladium, iridium, osmium and platinum, as taught by Berriman U.S. Pat. No. 3,367,778. The preferred foreign metal ions are polyvalent metal ions which include the above noted Group VIII dopants, as well as polyvalent metal ions such as lead, antimony, bismuth, and arsenic. In a preferred approach, the internal latent image sites can be formed within the silver halide grains during precipitation of silver halide. In an alternate approach, a core grain can be formed which is treated to form the internal image sites and then a shell deposited over the core grains, as taught by Porter et al, cited above.

The silver halide grains employed in the practice of this invention are preferably monodispersed and in some embodiments are preferably large grain emulsions made according to Wilgus German OLS 2,107,118, which is incorporated herein by reference. The monodispersed emulsions are those which comprise silver halide grains having a substantially uniform diameter. Generally, in such emulsions, no more than about 5 percent by number of the silver halide grains smaller than the mean grain size and/or no more than about 5 percent by number of the silver halide grains larger than the mean grain size vary in diameter from the mean grain diameter by more than about 40 percent. Preferred photographic emulsions of this invention comprise silver halide grains, at least 95 percent by weight of said grains having a diameter which is within 40 percent and preferably within about 30 percent of the mean grain diameter. Mean grain diameter, i.e., average grain size, can be determined using conventional methods, e.g., such as projective area, as shown in an article by Trivelli and Smith entitled "Empirical Relations Between Sensitometric and Size-Frequency Characteristics in Photographic Emulsion Series" in *The Photographic Journal,* Volume LXXIX, 1939, pages 330 through 338. The aforementioned uniform size distribution of silver halide grains is a characteristic of the grains in monodispersed photographic silver halide emulsions. Silver halide grains having a narrow size distribution can be obtained by controlling the conditions at which the silver halide grains are prepared using a double run procedure. In such a procedure, the silver halide grains are prepared by simultaneously running an aqueous solution of a silver salt, such as silver nitrate, and an aqueous solution of a water soluble halide, for example, an alkali metal halide such as potassium bromide, into a rapidly agitated aqueous solution of a silver halide peptizer, preferably gelatin, a gelatin derivative or some other protein peptizer. Suitable methods for preparing photographic silver halide emulsions having the required uniform particle size are disclosed in an article entitled "Ia: Properties of Photographic Emulsion Grains", by Klein and Moisar, *The Journal of Photographic Science,* Volume 12, 1964, pages 242 through 251; an article entitled "The Spectral Sensitization of Silver Bromide Emulsions on Different Crystallographic Faces", by Markocki, *The Journal of Photographic Science,* Volume 13, 1965, pages 85 through 89; an article entitled "Studies on Silver Bromide Sols, Part I. The Formation and Aging of Monodispersed Silver Bromide Sols", by Ottewill and Woodbridge, *The Journal of Photographic Science,* Volume 13, 1965, pages 98 through 103; and an article entitled "Studies on Silver Bromide Sols, Part II. The Effect of Additives on the Sol Particles", by Ottewill and Woodbridge, *The Journal of Photographic Science,* Volume 13, 1965, pages 104 through 107.

Where internal latent image sites have been formed through internal chemical sensitization or the use of metal dopants, the surface of the silver halide grains can be sensitized to a level below that which will produce substantial density in a surface developer, that is, less than 0.4 (preferably less than 0.25) when coated, exposed and surface developed as described below. The silver halide grains are preferably predominantly silver bromide grains chemically surface sensitized to a level which would provide a maximum density of at least 0.5 using undoped silver halide grains of the same size and halide composition when coated, exposed and developed as described above.

The silver halide emulsion can be unwashed or washed to remove soluble salts. The soluble salts can be removed by chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pages 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918 or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152.

Although surface chemical sensitization of internal latent image forming silver halide emulsion grains is not necessary, highest speeds are obtained when surface chemical sensitization is undertaken, but limited to retain a balance of surface and internal sensitivity favoring the formation of an internal latent image. Surface chemical sensitization can be undertaken using techniques such as those disclosed by Sheppard, Waller et al, McVeigh, or Dunn, cited above. The silver halide grains can also be surface sensitized with salts of the noble metals, such as, ruthenium, palladium and platinum. Representative compounds are ammonium chloropalladate, potassium chloroplatinate and sodium chloropalladite, which are used for sensitizing in amounts below that which produces any substantial fog inhibition, as described in Smith et al U.S. Pat. No. 2,448,060, and as antifoggants in higher amounts, as described in Trivelli et al U.S. Pat. Nos. 2,566,245 and 2,566,263. The silver halide grains can also be chemically sensitized with reducing agents, such as stannous salts (Carroll U.S. Pat. No. 2,487,850, polyamines, such as diethylene triamine (Lowe et al U.S. Pat. No. 2,518,698), polyamines, such as spermine (Lowe et al U.S. Pat. No. 2,521,925), or bis-($\beta$-aminoethyl)sulfide and its water soluble salts (Lowe et al U.S. Pat. No. 2,521,926).

Photographic emulsion layers, and other layers of photographic elements, such as, overcoat layers, interlayers, and subbing layers, as well as receiving layers in image transfer elements, can also contain as vehicles water permeable hydrophilic colloids as vehicles alone or in combination with vehicle extenders (e.g., in the form of latices), such as synthetic polymeric peptizers, carriers and/or binders. Such materials are more specifically described in *Research Disclosure,* Item 17643, cited above, Section IX. Vehicles are commonly employed with one or more hardeners, such as those described in Section X.

The layers of the photographic elements can be coated on any conventional photographic support. Typical useful photographic supports are disclosed in *Research Disclosure,* Item 17643, cited above, Section XVII.

A simple exposure and development process can be used to form a direct positive image. In one embodiment, a photographic element comprising at least one layer of a silver halide emulsion as described above can be imagewise exposed to light and then developed in a silver halide surface developer.

It is understood that the term "surface developer" encompasses those developers which will reveal the surface latent image on a silver halide grain, but will not reveal substantial internal latent image in an internal image forming emulsion, and under the conditions generally used develop a surface sensitive silver halide emulsion. The surface developers can generally utilize any of the silver halide developing agents or reducing agents, but the developing bath or composition is generally substantially free of a silver halide solvent (such as water soluble thiocyanates, water soluble thioethers, thiosulfates, and ammonia) which will disrupt or dissolve the grain to reveal substantial internal image. Low amounts of excess halide are sometimes desirable in the developer or incorporated in the emulsion as halide releasing compounds, but high amounts of iodide or iodide releasing compounds are generally avoided to prevent substantial disruption of the grain. Typical silver halide developing agents which can be used in the developing compositions employed with this invention include hydroquinones, catechols, aminophenols, 3-pyrazolidones, ascorbic acid and its derivatives, reductones and color developing agents, that is, primary aromatic amine developing agents, such as, aminophenols and paraphenylenediamines. The color developing agents are preferably employed in combination with black-and-white developing agents capable of acting as electron transfer agents. Illustrative of useful surface developers are those disclosed in Ives U.S. Pat. No. 2,563,785, Evans U.S. Pat. No. 3,761,276, Knott et al U.S. Pat. No. 2,456,953, and Juoy U.S. Pat. No. 3,511,662.

Where the developing agents are initially entirely incorporated in the photographic elements, the remaining components (e.g., water, activators to adjust pH, preservatives, etc.) normally present in surface developers constitute what is commonly referred to as an activator solution. Except for the omission of the developing agent, activator solutions are identical to developer solutions in composition and are employed identically with incorporated developing agent photographic elements. Subsequent references to developing compositions are inclusive of both developer and activator solutions.

The surface developers are alkaline. Conventional activators, preferably in combination with buffers, such as, sodium hydroxide, potassium hydroxide, sodium carbonate, potassium carbonate, trisodium phosphate or sodium metaphosphate, can be employed to adjust pH to a desired alkaline level. The amounts of these materials are selected so as to adjust the developer to the desired pH. The oxythioamido substituted arylhydrazides of this invention are generally useful over the same pH ranges as conventional arylhydrazides. The preferred pH is typically within the range of from 10 to 14, most preferably from about 10.5 to 13.

The developing compositions can contain certain antifoggants and development restrainers, or, optionally, they can be incorporated in layers of the photographic element. For example, in some applications, improved results can be obtained when the direct positive emulsions are processed in the presence of certain antifoggants, as disclosed in Stauffer U.S. Pat. No. 2,497,917, Land U.S. Pat. No. 2,704,721, Rogers et al U.S. Pat. No. 3,265,498, and Baldassari et al U.S. Pat. No. 3,925,086, which are incorporated herein by reference.

Preferred antifoggants are benzotriazoles, such as, benzotriazole (that is, the unsubstituted benzotriazole compound), halo-substituted benzotriazoles (e.g., 5-chlorobenzotriazole, 4-bromobenzotriazole, and 4-chlorobenzotriazole), and alkyl-substituted benzotriazoles wherein the alkyl moiety contains from about 1 to 12 carbon atoms (e.g., 5-methylbenzotriazole). Other known useful antifoggants include benzimidazoles, such as, 5-nitrobenzimidazole, benzothiazoles, such as, 5-nitrobenzothiazole and 5-methylbenzothiazole, heterocyclic thiones, such as, 1-methyl-2-tetrazoline-5-thione, triazines, such as, 2,4-dimethylamino-6-chloro-5-triazine, benzoxazoles, such as, ethylbenzoxazole, and pyrroles, such as, 2,5-dimethylpyrrole and the like.

Improved results are obtained when the element is processed in the presence of the antifoggants mentioned above. The antifoggants can be present in the processing solution during development or incorporated in the photographic element. It is preferred to incorporate the antifoggant in the processing solution. Concentrations of from about 1 mg to 5 grams per liter are contemplated, with concentrations of from about 5 to 500 mg per liter being preferred. Optimum antifoggant concentrations are a function of the specific antifoggant, element, and processing solution employed.

It is preferred to incorporate the oxythioamido substituted arylhydrazide nucleating agents in concentrations of from $10^{-5}$ to $10^{-2}$ mole per mole of silver halide, most preferably $10^{-5}$ to about $10^{-3}$ mole per mole of silver halide.

The essential features of the oxythioamido substituted arylhydrazide nucleating agents of this invention and the direct positive silver halide emulsions and photographic elements in which they are incorporated, as well as procedures for their use and processing, are described above. It is appreciated that, in preferred photographic applications, the emulsions and elements can contain additional features which are in themselves well known to those familiar with the photographic arts, such as those disclosed in *Research Disclosure,* Item 17643, cited above and here incorporated by reference. Certain specifically preferred features are described below.

The silver halide emulsions can be spectrally sensitized with cyanine, merocyanine, and other polymethine dyes and supersensitizing combinations thereof well known in the art. Spectral sensitizers in conventional surface sensitive emulsions are comparably effective in the emulsions of this invention. In general, they enhance nucleation. Nonionic, zwitterionic and anionic spectral sensitizers are preferred. Particularly effective are carboxy substituted merocyanine dyes of the thiohydantoin type described by Stauffer et al U.S. Pat. 2,490,758.

Effective red sensitizers are the carbocyanines of formula (XIII)

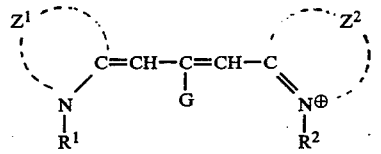

(XIII)

$(X)_{n-1}$ wherein each of $Z^1$ and $Z^2$ represents the atoms necessary to form a benzothiazole, benzoselenazole, naphthothiazole, or naphthoselenazole, the benzothiazole and benzoselenazole being preferably 5- and/or 6-substituted with groups such as lower alkyl, lower alkoxy, chloro, bromo, fluoro, hydroxy, acylamino, cyano, and trifluoromethyl, G represents hydrogen and lower alkyl, preferably ethyl or methyl, each of $R^1$ and $R^2$ represents lower alkyl or hydroxy(-lower)alkyl, at least one of $R^1$ and $R^2$ being preferably acid substituted(lower)alkyl, such as, carboxyethyl, sulfopropyl, and sulfatoethyl, X represents a charge balancing counter ion, and n is 1 or 2.

Particularly effective are certain supersensitizing combinations of the above dyes with each other and with dyes or other adsorbed organic compounds having polarographic oxidation potentials ($E_{ox}$) of about 0.3 to 0.9 volt. Many such combinations are described in Mees U.S. Pat. No. 2,075,048, Carroll et al U.S. Pat. Nos. 2,313,922, 2,533,426, 2,688,545, and 2,704,714, Jones U.S. Pat. No. 2,704,717, and Schwan 3,672,898, and include, as well, the acid substituted analogues thereof well known in the art.

Effective green sensitizers are carbocyanines and cyanines of formulas (XIV) and (XV)

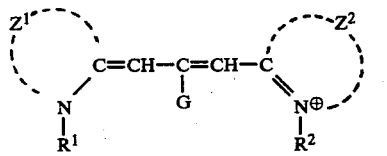

(XIV)

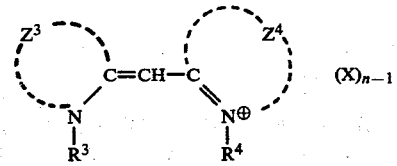

(XV)

wherein each of $Z^1$ and $Z^2$ represents the atoms necessary to form benzoxazole and benzimidazole nuclei, benzimidazole being substituted in the 3-position by lower alkyl or aryl, and preferably in the 5- and/or 6-positions with groups selected from fluoro, chloro, bromo, lower alkyl, cyano, acylamino and trifluoromethyl, and the benzoxazole ring preferably substituted in the 5- or 6-positions with lower alkyl, lower alkoxy, phenyl, fluoro, chloro, and bromo, $Z^3$ represents the atoms necessary to form benzothiazole, benzoselenazole, naphthothiazole, naphthoselenazole, or 2-quinoline, $Z^4$ represents the atoms necessary to form 2-quinoline, G represents lower alkyl and, if at least one of $Z^1$ and $Z^2$ forms benzimidazole, hydrogen, each of $R^1$, $R^2$, $R^3$ and $R^4$ represents lower alkyl or hydroxy(lower)alkyl, at least one of $R^1$ and $R^2$ and of $R^3$ and $R^4$ being preferably acid substituted (lower) alkyl such as carboxyethyl, sulfopropyl, and sulfatoethyl, X represents a charge balancing counter ion, and n is 1 or 2.

Particularly effective are certain supersensitizing combinations of the above dyes, such as those described in Carroll et al U.S. Pat. Nos. 2,688,545 and 2,701,198, Nys et al U.S. Pat. No. 2,973,264, and Schwan et al U.S. Pat. No. 3,397,069 and their acid substituted analogues well known in the art.

Effective blue sensitizers are simple cyanines and merocyanines of formulas (XVI) and (XVII)

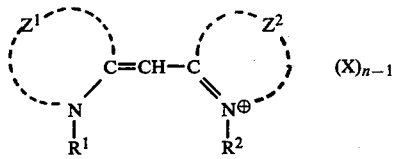

(XVI)

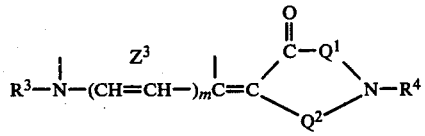

(XVII)

wherein each of $Z^1$ and $Z^2$ represents the atoms necessary to form benzothiazole, benzoselenazole, naphthothiazole and naphthoselenazole nuclei which may be substituted with groups such as chloro, methyl or methoxy, chloro, bromo, lower alkyl, or lower alkoxy, $Z^3$ represents benzothiazole, benzoselenazole which may be substituted as in $Z^1$ and $Z^2$, and a pyridine nucleus, $Q^1$ and $Q^2$ together represent the atoms necessary to complete a rhodanine, 2-thio-2,4-oxazolidinedione or 2-thiohydantoin ring, the latter having a second nitrogen atom with a substituent $R^5$, m represents 0 or 1, each of $R^1$, $R^2$ and $R^3$ represents lower alkyl or hydroxy(lower)alkyl, at least one of $R^1$ and $R^2$ being preferably acid substituted(lower)alkyl such as carboxyethyl, sulfopropyl, and sulfatoethyl, $R^4$ and $R^5$ represent lower alkyl and hydroxy (lower-)alkyl, and $R^4$ additionally can represent carboxyalkyl and sulfoalkyl, X is a charge balancing counter ion, and n is 1 or 2.

(Lower alkyl in each occurrence of Formulas XIII to XVII includes from 1 to 5 carbon atoms.)

In one preferred form the photographic elements can produce silver images. Specifically preferred photographic elements for producing silver images are those disclosed in Hoyen and Silverman U.S. Ser. Nos. 418,313 and 418,314, both filed Sept. 30, 1982, commonly assigned, and here incorporated by reference. In another preferred form the photographic elements can be color photographic elements which form dye images through the selective destruction, formation or physical removal of dyes.

The photographic elements can produce dye images through the selective destruction of dyes or dye precursors, such as silver-dye-bleach processes, as illustrated by A. Meyer, *The Journal of Photographic Science,* Volume 13, 1965, pages 90 through 97. Bleachable azo, azoxy, xanthene, azine, phenylmethane, nitroso complex, indigo, quinone, nitro substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291, and Anderau et al U.S. Pat. Nos. 3,178,285 and 3,178,290 as well as their hydrazo, diazonium, and tetrazolium precursors and leuco and shifted derivatives, as illustrated by U.K. Pat. Nos. 923,265, 999,996, and 1,042,300, Pelz et al. U.S.

Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372, and Puschel et al U.S. Pat. No. 3,561,970 can be employed.

The photographic elements can produce dye images through the selective formation of dyes, such as by reacting (coupling) a color developing agent (e.g., a primary aromatic amine) in its oxidized form with a dye forming coupler. The dye forming couplers can be incorporated in the photographic elements, as illustrated by Schneider et al, *Die Chemie,* Volume 57, 1944, page 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435, and Chen *Research Disclosure,* Volume 159, July 1977, Item 15930.

In one form, the dye forming couplers are chosen to form subtractive primary (i.e., yellow, magenta, and cyan) image dyes and are nondiffusible, colorless couplers, such as, two- and four-equivalent couplers of the open chain ketomethylene, pyrazolone, pyrazolotriazole, pyrazolobenzimidazole, phenol, and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316, and 2,367,531, Loria et al U.S. Pat. Nos. 2,772,161, 2,600,788, 3,006,759, 3,214,437, and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506, and 3,384,657, Porter et al U.S. Pat. No. 2,343,703, Greenhalgh et al U.S. Pat. No. 3,127,269, Feniak et al U.S. Pat. Nos. 2,865,748, 2,933,391, and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, and 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924, and Whitmore et al U.S. Pat. No. 3,227,550.

The photographic elements can incorporate alkali soluble ballasted couplers, as illustrated by Froelich et al and Tong, cited above. The photographic elements can be adapted to form nondiffusible image dyes using dye forming couplers in developers, as illustrated by U.K. Pat. No. 478,984, Yager et al U.S. Pat. No. 3,113,864, Vittum et al U.S. Pat. Nos. 3,002,836, 2,271,238, and 2,362,598, Schwan et al U.S. Pat. No. 2,950,970, Carroll et al U.S. Pat. No. 2,592,243, Porter et al U.S. Pat. No. 2,343,703, 2,376,380, and 2,369,489, Spath U.K. Pat. No. 886,723 and U.S. Pat. No. 2,899,306, Tuite U.S. Pat. No. 3,152,896, and Mannes et al U.S. Pat. Nos. 2,115,394, 2,252,718, and 2,108,602.

The dye forming couplers upon coupling can release photographically useful fragments, such as, development inhibitors or accelerators, bleach accelerators, developing agents, silver halide solvents, toners, hardeners, fogging agents, antifoggants, competing couplers, chemical or spectral sensitizers, and desensitizers. Development inhibitor releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436, and Matsuo et al U.S. Pat. No. 3,808,945. DIR compounds which do not form dye upon reaction with oxidized color developing agents can be employed, as illustrated by Fujiwhara et al German OLS 2,529,350 and U.S. Pat. Nos. 3,928,041, 3,958,993, and 3,961,959, Odenwalder et al German OLS 2,448,063, Tanaka et al German OLS No. 2,610,546, Kikuchi et al U.S. Pat. No. 4,049,455, and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445, and Rees et al U.S. Pat. No. 3,287,129.

The photographic elements can incorporate colored dye forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432, and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832, and Weller et al U.S. Pat. No. 2,689,793.

The photographic elements can produce dye images through the selective removal of dyes. Negative or positive dye images can be produced by the immobilization of incorporated color providing substances as a function of exposure and development, as illustrated by U.K. Pat. Nos. 1,456,413, 1,479,739, 1,475,265, and 1,471,752, Friedman U.S. Pat. No. 2,543,691, Whitmore U.S. Pat. No. 3,227,552, Bloom et al U.S. Pat. No. 3,443,940, Morse U.S. Pat. No. 3,549,364, Cook U.S. Pat. No. 3,620,730, Danhauser U.S. Pat. No. 3,730,718, Staples U.S. Pat. No. 3,923,510, Oishi et al U.S. Pat. No. 4,052,214, and Fleckenstein et al U.S. Pat. No. 4,076,529.

The photographic elements can contain antistain agents (i.e., oxidized developing agent scavengers) to prevent developing agents oxidized in one dye image layer unit from migrating to an adjacent dye image layer unit. Such antistain agents include ballasted or otherwise non-diffusing antioxidants, as illustrated by Weissberger et al U.S. Pat. No. 2,336,327, Loria et al U.S. Pat. No. 2,728,659, Vittum et al U.S. Pat. No. 2,360,290, Jelley et al U.S. Pat. No. 2,403,721, and Thirtle et al U.S. Pat. No. 2,701,197. To avoid autooxidation the antistain agents can be employed in combination with other antioxidants, as illustrated by Knechel et al U.S. Pat. No. 3,700,453.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337, and Smith et al U.S. Pat. No. 4,042,394.

This invention is particularly useful with photographic elements used in image transfer processes or in image transfer film units.

Image transfer systems include colloid transfer systems, as illustrated by Yutzy et al U.S. Pat. Nos. 2,596,756 and 2,716,059, silver salt diffusion transfer systems, as illustrated by Rott U.S. Pat. No. 2,352,014, Land U.S. Pat. No. 2,543,181, Yackel et al U.S. Pat. No. 3,020,155, and Land U.S. Pat. No. 2,861,885, imbibition transfer systems, as illustrated by Minsk U.S. Pat. No. 2,882,156, and color image transfer systems, as illustrated by *Research Disclosure,* Volume 151, November 1976, Item 15162, and Volume 123, July 1974, Item 12331.

Color image transfer systems (including emulsion layers, receiving layers, timing layers, acid layers, processing compositions, supports, and cover sheets) and the images they produce can be varied by choosing among a variety of features, combinations of which can be used together as desired.

Film units can be chosen which are either integrally laminated or separated during exposure, processing and/or viewing, as illustrated by Rogers U.S. Pat. No. 2,983,606, Beavers et al U.S. Pat. No. 3,445,228, Whitmore, Canadian Pat. No. 674,082, Friedman et al U.S. Pat. No. 3,309,201, Land U.S. Pat. Nos. 2,543,181, 3,053,659, 3,415,644, 3,415,645, and 3,415,646, and Barr et al U.K. Pat. No. 1,330,524.

A variety of approaches are known in the art for obtaining transferred dye images. The approaches can be generally categorized in terms of the initial mobility of dye or dye precursor. (Initial mobility refers to the mobility of the dye or dye precursor when it is contacted by the processing solution. Initially mobile dyes and dye precursors as coated do not migrate prior to contact with processing solution.)

Dye image providing compounds are classified as either positive working or negative working. Positive working dye image providing compounds are those which produce a positive transferred dye image when employed in combination with a conventional, negative working silver halide emulsion. Negative working dye image providing compounds are those which produce a negative transferred dye image when employed in combination with conventional, negative working silver halide emulsions. When, as in the present invention, the silver halide emulsions are direct positive emulsions, positive working dye image providing compounds produce negative transferred dye images and negative working dye image providing compounds produce positive transferred dye images.

Image transfer systems, which include both the dye image providing compounds and the silver halide emulsions, are positive working when the transferred dye image is positive and negative working when the transferred dye image is negative. When a retained dye image is formed, it is opposite in sense to the transferred dye image.

A variety of dye image transfer systems have been developed and can be employed in the practice of this invention. One approach is to employ ballasted dye forming (chromogenic) or nondye forming (nonchromogenic) couplers having a mobile dye attached at a coupling-off site. Upon coupling with an oxidized color developing agent, such as a para-phenylenediamine, the mobile dye is displaced so that it can transfer to a receiver. This negative working image transfer approach is illustrated by Whitmore et al U.S. Pat. No. 3,227,550, Whitmore U.S. Pat. No. 3,227,552, and Fujihara et al U.K. Pat. No. 1,445,797, the disclosures of which are here incorporated by reference.

In a preferred image transfer system according to this invention employing negative working dye image providing compounds, a cross oxidizing developing agent (electron transfer agent) develops silver halide and then cross oxidizes with a compound containing a dye linked through an oxidizable sulfonamido group, such as a sulfonamidophenol, sulfonamidoaniline, sulfonamidoanilide, sulfonamidopyrazolobenzimidazole, sulfonamidoindole or sulfonamidopyrazole. Following cross oxidation, hydrolytic deamidation cleaves the mobile dye with the sulfonamido group attached. Such systems are illustrated by Fleckenstein U.S. Pat. Nos. 3,928,312 and 4,053,312, Fleckenstein et al U.S. Pat. No. 4,076,529, Melzer et al U.K. Pat. No. 1,489,694, Deguchi, German OLS 2,729,820, Koyama et al, German OLS 2,613,005, Vetter et al German OLS 2,505,248, and Kestner et al *Research Disclosure,* Volume 151, November 1976, Item 15157. Also specifically contemplated are otherwise similar systems which employ an immobile, dye releasing (a) hydroquinone, as illustrated by Gompf et al U.S. Pat. No. 3,698,897 and Anderson et al U.S. Pat. No. 3,725,062, (b) para-phenylenediamine, as illustrated by Whitmore et al Canadian Pat. No. 602,607, or (c) quaternary ammonium compound, as illustrated by Becker et al U.S. Pat. No. 3,728,113.

Another specifically contemplated dye image transfer system which is negative working reacts an oxidized electron transfer agent or, specifically, in certain forms, an oxidized para-phenylenediamine with a ballasted phenolic coupler having a dye attached through a sulfonamido linkage. Ring closure to form a phenazine releases mobile dye. Such an imaging approach is illustrated by Bloom et al U.S. Pat. Nos. 3,443,939 and 3,443,940.

In still another negative working system, ballasted sulfonylamidrazones, sulfonylhydrazones or sulfonylcarbonylhydrazides can be reacted with oxidized paraphenylenediamine to release a mobile dye to be transferred, as illustrated by Puschel et al U.S. Pat. Nos. 3,628,952 and 3,844,785. In an additional negative working system, a hydrazide can be reacted with silver halide having a developable latent image site and thereafter decompose to release a mobile, transferable dye, as illustrated by Rogers U.S. Pat. No. 3,245,789, Kohara et al, *Bulletin Chemical Society of Japan,* Volume 43, pages 2433 through 2437, and Lestina et al *Research Disclosure,* Volume 28, December 1974, Item 12832.

Image transfer systems employing negative working image dye providing compounds are also known in which dyes are not initially present, but are formed by reactions occurring in the photographic element or receiver following exposure. For example, a ballasted coupler can react with color developing agent to form a mobile dye, as illustrated by Whitmore et al U.S. Pat. No. 3,227,550, Whitmore U.S. Pat. No. 3,227,552, Bush et al U.S. Pat. No. 3,791,827, and Viro et al U.S. Pat. No. 4,036,643. An immobile compound containing a coupler can react with oxidized para-phenylenediamine to release a mobile coupler which can react with additional oxidized para-phenylenediamine before, during or after release to form a mobile dye, as illustrated by Figueras et al U.S. Pat. No. 3,734,726 and Janssens et al German OLS No. 2,317,134. In another form, a ballasted amidrazone reacts with an electron transfer agent as a function of silver halide development to release a mobile amidrazone which reacts with a coupler to form a dye at the receiver, as illustrated by Ohyama et al U.S. Pat. No. 3,933,493.

An image to be viewed can be transferred from the image forming layers. A retained image can be formed for viewing as a concurrently formed complement of the transferred image. Positive transferred images and useful negative retained images can be formed with the direct positive silver halide emulsions of this invention when imaging chemistry is negative working. Images retained in and transferred from the image forming layers are illustrated by U.K. Pat. No. 1,456,413, Friedman U.S. Pat. No. 2,543,691, Bloom et al U.S. Pat. No. 3,443,940, Staples U.S. Pat. No. 3,923,510, and Fleckenstein et al U.S. Pat. No. 4,076,529.

Where mobile dyes are transferred to the receiver a mordant is commonly present in a image dye providing layer. Mordants and mordant containing layers are described in the following references which are incorporated by reference: Sprague et al U.S. Pat. No. 2,548,564, Weyerts U.S. Pat. No. 2,548,575, Carroll et al U.S. Pat. No. 2,675,316, Yutzy et al U.S. Pat. No. 2,713,305, Saunders et al U.S. Pat. No. 2,756,149, Reynolds et al U.S. Pat. No. 2,768,078, Gray et al U.S. Pat. No. 2,839,401, Minsk U.S. Pat. Nos. 2,882,156 and 2,945,006, Whitmore et al U.S. Pat. No. 2,940,849, Condax U.S. Pat. No. 2,952,566, Mader et al U.S. Pat. No. 3,016,306, Minsk et al U.S. Pat. Nos. 3,048,487 and 3,184,309, Bush U.S. Pat. No. 3,271,147, Whitmore U.S. Pat. No. 3,271,148, Jones et al U.S. Pat. No. 3,282,699, Wolf et al U.S. Pat. No. 3,408,193, Cohen et al U.S. Pat. Nos. 3,488,706, 3,557,066, 3,625,694, 3,709,690, 3,758,445, 3,788,855, 3,898,088, and 3,944,424, Cohen U.S. Pat. No. 3,639,357, Taylor U.S. Pat. No. 3,770,439, Campbell et al U.S. Pat. Nos. 3,958,995 and 4,193,795; and Ponticello et al *Research Disclosure,* Vol. 120, April 1974, Item 12045.

One-step processing can be employed, as illustrated by U.K. Pat. No. 1,471,752, Land U.S. Pat. No. 2,543,181, Rogers U.S. Pat. No. 2,983,606 (pod processing), Land U.S. Pat. No. 3,485,628 (soak image former and laminate to receiver) and Land U.S. Pat. No. 3,907,563 (soak receiver and laminate to image forming element) or multi-step processing can be employed, as illustrated by Yutzy U.S. Pat. No. 2,756,142, Whitmore et al U.S. Pat. No. 3,227,550, and Faul et al U.S. Pat. No. 3,998,637.

Preformed reflective layers can be employed, as illustrated by Whitmore Canadian Pat. No. 674,082, Beavers U.S. Pat. No. 3,445,228, Land U.S. Pat. Nos. 2,543,181, 3,415,644, '645 and '646, and Barr et al U.K. Pat. No. 1,330,524 or processing formed reflective layers can be employed, as illustrated by Land U.S. Pat. Nos. 2,607,685 and 3,647,437, Rogers U.S. Pat. No. 2,983,606, and Buckler U.S. Pat. No. 3,661,585.

Generally, the image transfer film units in accordance with this invention comprise:

(1) a photographic element comprising a support having thereon at least one silver halide emulsion layer containing radiation sensitive internal latent image silver halide grains and a nucleating agent, the emulsion layer preferably having in contact therewith an image dye providing material, (2) an image receiving layer, which can be located on a separate support and superposed or adapted to be superposed on the photographic element or, preferably, can be coated as a layer in the photographic element, (3) an alkaline processing composition, (4) means containing and adapted to release the alkaline processing composition into contact with the emulsion layer, and (5) a silver halide developing agent located in at least one of the photographic element and alkaline processing composition so that the processing composition and developing agent, when brought together, form a silver halide surface developer.

In highly preferred embodiments, the film units of this invention contain a support having thereon a layer containing a blue sensitive emulsion and in contact therewith a yellow image dye providing material, a red sensitive silver halide emulsion and in contact therewith a cyan image dye providing material, and a green sensitive emulsion and in contact therewith a magenta image dye providing material, and preferably all of said image dye providing materials are initially immobile image dye providing materials.

The terms "diffusible" (or "mobile") and "immobile" (or "nondiffusible"), as used herein, refer to compounds which are incorporated in the photographic element and, upon contact with an alkaline processing solution, are substantially diffusible or substantially immobile, respectively, in the hydrophilic colloid layers of a photographic element.

The term "image dye providing material", as used herein, is understood to refer to those compounds which are employed to form dye images in photographic elements. These compounds include dye developers, shifted dyes, color couplers, oxichromic compounds, dye redox releasers, etc, as described above in connection with positive working and negative working image transfer systems.

In one preferred embodiment, the receiver layer is coated on the same support with the photosensitive silver halide emulsion layers, the support is preferably a transparent support, an opaque layer is preferably positioned between the image receiving layer and the photosensitive silver halide layer, and the alkaline processing composition preferably contains an opacifying substance, such as carbon or a pH-indicator dye which is discharged into the film unit between a dimensionally stable support or cover sheet and the photosensitive element.

In certain embodiments, the cover sheet can be superposed or is adapted to be superposed on the photosensitive element. The image receiving layer can be located on the cover sheet so that it becomes an image receiving element. In certain preferred embodiments where the image receiving layer is located in the photosensitive element, a neutralizing layer is located on the cover sheet.

Increases in maximum density can be obtained in color image transfer film units containing internally sulfur and gold sensitized emulsions of the type described by Evans U.S. Pat. No. 3,761,276 and sulfonamidonaphthol redox dye releasing compounds of the type described by Fleckenstein U.K. Pat. No. 1,405,662 by incorporation into the emulsion layers of a variety of chemical addenda generally recognized in the art as antifoggants or development inhibitors, as well as hydrolyzable precursors thereof. Many of these compounds also provide improved stabilization of sensitometric properties of liquid emulsion and of the storage life of the coated emulsion. The effects, shown in film units of the type described in Examples 40 through 42 of U.K. Pat. No. 1,405,662, are in addition to the effect of 5-methylbenzotriazole in the processing composition even when the latter is present in quantities as high as 4 grams per liter. Effective compounds in general are selected from the group consisting of (a) 1,2,3-triazoles, tetrazoles and benzotriazoles having an N—$R^1$ group in the heterocyclic ring, wherein $R^1$ represents hydrogen or an alkali-hydrolyzable group, or (b) heterocyclic mercaptans or thiones and precursors thereof, mostly having one of the formulas (XVIII) or (XIX):

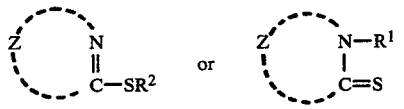

(XVIII) (XIX)

wherein

Z comprises the atoms necessary to complete an azole ring, and $R^2$ represents, in addition to the groups specified above for $R^1$, a metal ion.

The compounds are generally employed at concentrations less than about 300 mg per mole of silver, each compound having an optimum concentration above which development and/or nucleation are inhibited and $D_{max}$ decreases with increasing concentration. Specifically preferred antifoggants and stabilizers, as well as other preferred color image transfer film unit and system features, are more specifically disclosed in *Research Disclosure,* Volume 151, November 1976, Item 15162, the disclosure of which is hereby incorporated by reference.

A more detailed description of useful image transfer film units and systems is contained in the patents relating to image transfer cited above, the disclosures of which are here incorporated by reference. A specific preferred image transfer film unit and image transfer system is that disclosed by U.S. Patents P-2, P-3, and P-13, cited above, and here incorporated by reference.

In a specific preferred form the photographic elements of this invention are intended to produce multicolor images which can be viewed in the elements or in a receiver when the elements form a part of a multicolor image transfer system. For multicolor imaging at least three superimposed color forming layer units are coated on a support. Each of the layer units is comprised of at least one silver halide emulsion layer. At least one of the silver halide emulsion layers, preferably at least one of the silver halide emulsion layers in each color forming layer unit and most preferably each of the silver halide emulsion layers, contain an emulsion according to this invention substantially as described above. The emulsion layers of one of the layer units are primarily responsive to the blue region of the spectrum, the emulsion layers of a second of the layer units are primarily responsive to the green region of the spectrum, and the emulsion layers of a third of the layer units are primarily responsive to the red region of the spectrum. The layer units can be coated in any conventional order. In a preferred layer arrangement the red responsive layer unit is coated nearest the support and is overcoated by the green responsive layer unit, a yellow filter layer and a blue responsive layer unit. When high aspect ratio tabular grain silver halide emulsions are employed, additional preferred layer order arrangements are those disclosed in *Research Disclosure,* Vol. 225, January 1983, Item 22534, here incorporated by reference. The layer units each contain in the emulsion layers or in adjacent hydrophilic colloid layers at least one image dye providing compound. Such compounds can be selected from among those described above. Incorporated dye forming couplers and redox dye releasers constitute exemplary preferably image dye providing compounds. The blue, green, and red responsive layer units preferably contain yellow, magenta, and cyan image dye providing compounds, respectively.

Negative Working Imaging

The oxythioamido substituted arylhydrazides are capable of increasing the speed of negative working surface latent image forming silver halide emulsions. Surface latent image silver halide grains are employed in the overwhelming majority of negative working silver halide emulsions, whereas internal latent image forming silver halide grains, though capable of forming a negative image when developed in an internal developer, are usually employed with surface developers to form direct positive images. The distinction between surface latent image and internal latent image silver halide grains is generally well recognized in the art. Generally some additional ingredient or step is required in preparation to form silver halide grains capable of preferentially forming an internal latent image as compared to a surface latent image.

Although the difference between a negative image produced by a surface latent image emulsion and a positive image produced by an internal latent image emulsion when processed in a surface developer is a qualitative difference which is visually apparent to even the unskilled observer, a number of tests have been devised to distinguish quantitatively surface latent image forming and internal latent image forming emulsions. For example, according to one such test when the sensitivity resulting from surface development (A), described below, is greater than that resulting from internal development (B), described below, the emulsion being previously light exposed for a period of from 1 to 0.01 second, the emulsion is of a type which is "capable of forming a surface latent image" or, more succinctly, it is a surface latent image emulsion. The sensitivity is defined by the following equation:

$$S=100/Eh$$

in which S represents the sensitivity and Eh represents the quantity of exposure necessary to obtain a mean density—i.e., ½ (D-max+D-min).

Surface Development (A)

The emulsion is processed at 20° C. for 10 minutes in a developer solution of the following composition:

| | |
|---|---|
| N—methyl-p-aminophenol hemisulfate | 2.5 g |
| Ascorbic acid | 10 g |
| Sodium metaborate (with 4 molecules of water) | 35 g |
| Potassium bromide | 1 g |

-continued

| | |
|---|---|
| Water to bring the total to | 1 liter. |

Internal Development (B)

The emulsion is processed at about 20° C. for 10 minutes in a bleaching solution containing 3 g of potassium ferricyanide per liter and 0.0125 g of phenosafranine per liter and washed with water for 10 minutes and developed at 20° C. for 10 minutes in a developer solution having the following composition:

| | |
|---|---|
| N—methyl-p-aminophenol hemisulfate | 2.5 g |
| Ascorbic acid | 10 g |
| Sodium metaborate (with 4 molecules of water) | 35 g |
| Potassium bromide | 1 g |
| Sodium thiosulfate | 3 g |
| Water to bring the total to | 1 liter. |

The surface latent image forming silver halide emulsions can be comprised of any photographically useful halide or halide mixture (e.g., silver bromide, silver chloride, silver bromoiodide, silver chlorobromide, and silver chlorobromoiodide). For highest attainable speeds, silver bromoiodide emulsions are preferred. The emulsions can include coarse, medium, or fine silver halide grains bounded by {100}, {111}, and/or {110} crystal planes and can be prepared by a variety of techniques—e.g., single-jet, double-jet (including continuous removal techniques), accelerated flow rate and interrupted precipitation techniques, as illustrated by Trivelli and Smith, *The Photographic Journal,* Vol. LXXIX, May, 1939, pages 330–338; T. H. James *The Theory of the Photographic Process,* 4th Ed., Macmillan, 1977, Chapter 3; Terwilliger et al *Research Disclosure,* Vol. 149, September 1976, Item 14987; as well as Nietz et al U.S. Pat. No. 2,222,264; Wilgus German OLS 2,107,118; Lewis U.K. Pat. Nos. 1,335,925, 1,430,465 and 1,469,480; Irie et al U.S. Pat. No. 3,650,757; Morgan U.S. Pat. No. 3,917,485, where pAg cycling is limited to permit retention of surface developability; and Musliner U.S. Pat. No. 3,790,387. The emulsions can be either polydispersed or monodispersed. The same criteria for defining and techniques for achieving monodispersity discussed above in connection with direct positive emulsions are also applicable to these emulsions. Sensitizing compounds, such as compounds of copper, thallium, cadmium, rhodium, tungsten, thorium, iridium and mixtures thereof, can be present during precipitation of the silver halide emulsion, as illustrated by Arnold et al U.S. Pat. No. 1,195,432; Hochstetter U.S. Pat. No. 1,951,933; Overman U.S. Pat. No. 2,628,167; Mueller U.S. Pat. No. 2,950,972; Sidebotham U.S. Pat. No. 3,488,709 and Rosecrants et al U.S. Pat. No. 3,737,313.

The individual reactants can be added to the reaction vessel through surface or sub-surface delivery tubes by gravity feed or by delivery apparatus for maintaining control of the pH and/or pAg of the reaction vessel contents, as illustrated by Culhane et al U.S. Pat. No. 3,821,002, Oliver U.S. Pat. No. 3,031,304 and Claes et al *Photographische Korrespondenz,* Band 102, Number 10, 1967, page 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Saito et al German OLS 2,556,885 and Sato et al German OLS 2,555,365. An enclosed reaction vessel can be employed to receive and mix reactants upstream of the main reaction vessel, as illustrated by Forster et al U.S. Pat. No. 3,897,935 and Posse et al U.S. Pat. No. 3,790,386.

The grain size distribution of the silver halide emulsions can be controlled by silver halide grain separation techniques or by blending silver halide emulsions of differing grain sizes. The emulsions can include ammoniacal emulsions, as illustrated by *Photographic Chemistry,* Vol. 1, Fountain Press, London, 1958, pages 365–368 and pages 301–304; thiocyanate ripened emulsions, as illustrated by Illingsworth U.S. Pat. No. 3,320,069; thioether ripened emulsions as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

Particularly preferred emulsions are high aspect ratio tabular grain emulsions, such as those described in *Research Disclosure,* Item 22534, cited above. Most specifically preferred are high aspect ratio tabular grain silver bromoiodide emulsions also described in Wilgus et al U.S. Ser. No. 429,420, Kofron et al U.S. Ser. No. 429,407, and Solberg et al U.S. Ser. No. 431,913, each filed Sept. 30, 1982, each commonly assigned, and each here incorporated by reference. High aspect ratio tabular grain emulsions are those in which the tabular grains having a diameter of at least 0.6 micron and a thickness of less than 0.5 micron (preferably less than 0.3 micron) have an average aspect ratio of greater than 8:1 (preferably at least 12:1) and account for greater than 50 percent (preferably greater than 70 percent) of the total projected area of the silver halide grains present in the emulsion.

These silver halide emulsions employed to obtain increased photographic imaging speeds as well as other layers of the photographic elements can contain vehicles identical to those described above for direct positive imaging. Conventional proportions of vehicle to silver halide are employed. The emulsions can be washed as described above for direct positive imaging.

It is preferred that the surface latent image forming silver halide emulsions be surface chemically sensitized. Surface chemical sensitization can be undertaken by any convenient conventional technique, typically by one or a combination of middle chalcogen (i.e., sulfur, selenium, and/or tellurium), noble metal (e.g., gold or Group VIII noble metal), or reduction sensitization techniques. Such techniques are illustrated by *Research Disclosure,* Item 17643, cited above, Section III, here incorporated by reference. Preferred high speed surface latent image forming emulsions are gold sensitized emulsions. For example, gold sensitization can be undertaken as taught by Damshroder et al U.S. Pat. No. 2,642,361. Combinations of gold sensitization with middle chalcogen sensitization are specifically contemplated. Generally the highest photographic speeds are achieved with sulfur and gold sensitized silver bromoiodide emulsions, such as taught by Illingsworth U.S. Pat. No. 3,320,069.

Spectral sensitization of the surface latent image forming emulsions can be identical to that described above for direct positive imaging or can embrace any conventional spectral sensitization of surface latent image forming negative working emulsions, such as illustrated by *Research Disclosure,* 17643, cited above, Section IV, here incorporated by reference. Kofron et al, cited above, discloses substantially optimum chemical and spectral spectral sensitizations for high aspect ratio tabular grain silver halide emulsions, particularly silver bromide and silver bromoiodide emulsions.

In their simplest form photographic elements useful in obtaining increased imaging speed need only contain a single layer of an emulsion as described coated on a conventional photographic support. The supports can be identical to those of the direct positive photographic elements. Apart from the requirement of at least one silver halide emulsion layer as described above, the photographic elements can take any convenient conventional form. The photographic elements can produce either silver or dye (including multicolor dye) images. The photographic elements can be similar to the photographic elements described above in connection with direct positive imaging, except that negative working surface latent image forming emulsion is substituted for the internal latent image forming emulsion.

The photographic elements can be used to form either retained or transferred images. When employed to form transferred dye images, the image transfer film units can be similar to those described above in connection with direct positive imaging. However, the high speed negative working emulsion or emulsions are substituted for the direct positive emulsion or emulsions present and therefore positive working transferred dye image providing chemistry will usually be desirably substituted for negative working transferred dye image providing chemistry to provide a positive transferred image. Such modifications are, of course, well within the skill of the art. For image transfer systems useful with the negative working surface latent image forming emulsions, attention is directed to *Research Disclosure,* Item 17643, cited above, Section XXIII, here incorporated by reference. Where high aspect ratio tabular grain emulsions are employed, preferred image transfer systems are those disclosed in *Research Disclosure* Item 22534, cited above.

Antifoggants and stabilizers can be present in the photographic element and/or in the processing solution. Although the antifoggants and stabilizers preferred in connection with direct positive and high contrast imaging can be advantageously employed, the use of conventional antifoggants and stabilizers known to be useful with surface latent image forming emulsions is specifically contemplated. Useful antifoggants and stabilizers are specifically disclosed by *Research Disclosure,* Item 17643, cited above, Section VI, here incorporated by reference.

The oxythioamido substituted arylhydrazide is incorporated directly in the silver halide emulsion, rather than being in a separate layer of the photographic element. To avoid elevated levels of minimum density the arylhydrazide is incorporated in a concentration of less than $10^{-2}$ mole per mole of silver. Although any effective amount can be employed, concentrations of at least about $10^{-7}$ mole per silver mole are specifically contemplated, with a range of from about $10^{-6}$ to about $10^{-4}$ mole per mole of silver being preferred.

The increased speed advantages of this invention can be realized employing conventional exposure and processing. Exposure and processing of the photographic elements can be identical to that previously described in connection with direct positive and high contrast imaging, although this is not essential. Generally any conventional manner of exposing and processing surface latent image negative working emulsions can be employed, such as those illustrated by *Research Disclosure,* Item 17643, Sections XVIII, XIX, and XX, here incorporated by reference. The same pH ranges as described above are generally preferred for processing the increased speed photographic elements.

Except as otherwise stated the remaining features of the direct positive and increased speed applications of the invention should be understood to contain features recognized in the art for such photographic applications.

EXAMPLES

The invention can be better appreciated by reference to following specific examples:

EXAMPLE 1

Preparation of O-ethyl-N-[4-(2-formylhydrazino)phenyl]thiocarbamate (Compound A)

4-(2-Formylhydrazino)phenylisothiocyanate (0.4 g, 2 mmoles) and 50 ml of ethanol were combined and heated at reflux for 12 hours. The solution was cooled and placed in the refrigerator overnight. The product was collected by filtration and dried, 0.2 g (40% yield) mp 170°–173° C.

Anal. for: $C_{10}H_{13}N_3O_2S$: Calcd: C, 50.2; H, 5.4; N, 17.6; Found: C, 50.0; H, 5.5; N, 17.4.

EXAMPLE 2

Preparation of O-methyl-N-[4-(2-formylhydrazino)phenyl]thiocarbamate (Compound B)

4-(2-Formylhydrazino)phenylisothiocyanate (5.0 g, 26 mmoles) and 200 ml of methanol were combined and heated at reflux overnight. The mixture was filtered and the solvent was evaporated to give an oil. The oil was dissolved in 50 ml of ethyl acetate and placed in the refrigerator overnight. The solid product was collected by filtration (2.0 g) and recrystallized from ethyl acetate to give 1.0 g of product (17% yield) mp 162°–165° C.

Anal. for: $C_9H_{11}N_3O_2S$: Calcd: C, 48.0; H, 4.9; N, 18.7; Found: C, 48.2; H, 4.9; N, 18.2.

EXAMPLE 3

Preparation of O-ethyl-N-[4-(2-acetylhydrazino)phenyl]thiocarbamate (Compound C)

4-(2-Acetylhydrazino)phenylisothiocyanate (2.0 g, 10 mmoles) and 150 ml of ethanol were combined and heated at reflux for 2 days. The solvent was evaporated and the resulting oil was slurried with ether. A solid was collected by filtration and dried to give 1.75 g of material mp 160°–164° C. Recrystallization from ethyl acetate gave 1.2 g of product (50% yield) mp 166°–168° C.

Anal. for: $C_{11}H_{15}N_3O_2S$: Calcd: C, 52.2; H, 5.9; N, 16.6; Found: C, 52.0; H, 6.0; N, 16.5.

EXAMPLE 4

Preparation of O-ethyl-N-{4-[2-(4-chlorobenzoyl)hydrazino]phenyl} thiocarbamate (Compound D)

4-Amino-[2-(4-chlorobenzoyl)hydrazino]phenyl hydrochloride (2.0 g, 7 mmoles) and pyridine (1.1 g, 14 mmoles) were combined in 100 ml of dry acetonitrile. Ethoxythiocarbonyl chloride (0.8 g, 7 mmoles) in 10 ml of acetonitrile was added dropwise. The mixture was heated to reflux, filtered, and heated an additional 15 minutes. The heat source was removed; the solution was stirred one hour and the solvent was evaporated. The material was dissolved in methylene chloride and extracted thoroughly with water; the solution was dried (magnesium sulfate) and the solvent was evaporated. Column chromatography (silica gel, 50/50 ethermethylene chloride) removed impurities. Fractions containing the product were combined and the solvent was evaporated. The product crystallized out of ether-ligroin solution to give 0.75 g (33% yield) of product mp 162°-164° C.

Anal. for: $C_{16}H_{16}ClN_3O_2S$: Calcd: C, 54.9; H, 4.6; N, 12.0; Found: C, 55.1; H, 4.7; N, 12.2.

EXAMPLE 5

Preparation of O-phenyl-N-[4-(2-formylhydrazino)phenyl]thiocarbamate (Compound E)

1-(4-Aminophenyl)-2-formylhydrazine (1.5 g, 10 mmoles) and pyridine (0.8 g. 10 mmoles) were combined in 75 ml of acetonitrile. When most of the material had dissolved the solution was filtered into a mixture of phenoxythiocarbonyl chloride (1.7 g, 10 mmoles) in 20 ml of acetonitrile. The mixture was stirred 6 hours at room temperature and a solid was removed by filtration and dried to give 1.5 g (52% yield) of product, mp 183°-185° C.

Anal. for: $C_{14}H_{13}N_3O_2S$: Calcd: C, 58.5; H, 4.6; N, 14.6; Found: C, 58.5; H, 4.6; N, 14.5.

EXAMPLE 6

Preparation of O-(4-methoxyphenyl)-N-[4-(2-formylhydrazino)-phenyl]thiocarbamate (Compound F)

Compound F was prepared in a manner analogous to E by combining 1-(aminophenyl)-2-formylhydrazine (1.5 g, 10 mmoles), pyridine (0.8 g, 10 mmoles) and 4-methoxyphenoxythiocarbonyl chloride (1.9 g, 10 mmoles) in 75 ml of acetonitrile to give 2.45 g (77% yield) of product, mp 193°-195° C.

Anal. for: $C_{15}H_{15}N_3O_3S$: Calcd: C, 56.7; H, 4.7; N, 13.2; Found: C, 56.8; H, 4.8; N, 13.3.

EXAMPLE 7

Preparation of O-(4-chlorophenyl-N-[4-(2-formylhydrazino)phenyl]-thiocarbamate (Compound G)

Compound G, was prepared in a manner analogous to E by combining 1-(4-aminophenyl)-2-formylhydrazine (1.5 g, 10 mmoles), pyridine (0.8 g, 10 mmoles) and 4-chlorophenoxythiocarbonyl chloride (2.1 g, 10 mmoles) in 75 ml of acetonitrile to give 2.0 g (62% yield) of product mp 190°-192° C.

Anal. for: $C_{14}H_{12}ClN_3O_2S$: Calcd: C, 52.2; H, 3.7; N, 13.0; Found: C, 52.1; H, 3.8; N, 13.0.

COMPARATIVE EXAMPLE 8

Preparation of O-phenyl-N-benzyl-N-[4-(2-formylhydrazino)phenyl]-thiocarbamate (Compound H)

1-(4-Benzylaminophenyl)-2-formylhydrazine (1.2 g, 5 mmoles) and pyridine (0.4 g, 5 mmoles) were combined in 75 ml of acetonitrile. After the mixture was filtered, phenoxythiocarbonyl chloride (1.2 g 5 mmoles) in 25 ml of acetonitrile was added dropwise. The mixture was heated for 45 minutes at reflux. After cooling the solvent was evaporated to give an oil. The oil was slurried several times with ether; the ether portions were discarded. The oil was dissolved in methylene chloride and washed thoroughly with water and dried (magnesium sulfate); the solvent was evaporated to give 0.6 g (33% yield) of product mp 78°-80° C.

Anal. for: $C_{21}H_{19}N_3O_2S.\frac{1}{2}H_2O$: Calcd: C, 65.3; H, 5.2; N, 10.9; Found: C, 65.7; H, 5.2; N, 10.8.

COMPARATIVE EXAMPLE 9

Preparation of O-(4-methoxyphenyl)-N-benzyl-N-[4-(2-formylhydrazino)-phenyl]thiocarbamate (Compound I)

Compound I was prepared in a manner analogous to H by combining 1-[4-(N-benzylamino)phenyl]-2-formylhydrazine (1.2 g, 5 mmoles) pyridine (0.4 g, 5 mmoles) and 4-methoxyphenoxythiocarbonyl chloride (0.9 g, 5 mmoles). The product was purified by column chromatography (silica gel, ether eluant) to give 1.0 g of white solid (50% yield) mp 72°-76° C.

Anal. for: $C_{22}H_{21}N_3O_3S$: Calcd: C, 64.8; H, 5.2; N, 10.3; Found: C, 64.0; H, 5.2; N, 10.0.

COMPARATIVE EXAMPLE 10

Preparation of O-(4-chlorophenyl)-N-benzyl-N-[4-(2-formylhydrdazino)phenyl]thiocarbamate (Compound J)

Compound J was prepared in a manner analogous to H by combining 1-[4-(N-benzylamino)phenyl]-2-formylhydrazine (1.2 g, 5 mmoles), pyridine (0.4 g, 5 mmoles) and 4-chlorophenoxythiocarbonyl chloride (1.0 g, 5 mmoles). The product was purified by column chromatography (silica gel, ether eluant) to give 1.1 g of white solid (55% yield) mp 75°-80° C.

Anal. for: $C_{21}H_{18}ClN_3O_2S$: Calcd: C, 61.2; H, 4.4; N, 10.2; Found: C, 60.7; H, 4.3; N, 9.9.

EXAMPLE 11

Preparation of O-ethyl-N-benzyl-N-[4-(2-formylhydrazino)phenyl]thiocarbamate (Compound K)

Compound K was prepared in a manner analogous to H by combining 1-[4-(N-benzylamino)phenyl]-2-formylhydrazine (1.2 g, 5 mmoles), pyridine (0.4 g, 5 mmoles) and ethoxythiocarbonyl chloride (0.6 g, 5 mmoles). The product was purified by column chromatography (silica gel, 10% ether—90% methylene chloride eluant) to give 0.8 g (50% yield) of product mp 122°-124° C.

Anal. for: $C_{17}H_{19}N_3O_2S$: Calcd: C, 62.0; H, 5.8; N, 12.8; Found: C, 61.4; H, 5.9; N, 12.5.

COMPARATIVE EXAMPLE 12

Preparation of S-phenyl-N-[4-(2-formylhydrazino)phenyl]dithiocarbamate (Compound L)

Compound L was prepared in a manner analogous to H by combining 1-(4-Aminophenyl)-2-formylhydrazine (1.0 g, 7 mmoles) pyridine (0.6 g, 7 mmoles) and thiophenoxythiocarbonyl chloride (1.3 g, 7 mmoles). The product was purified by column chromatography (silica gel). Elution with ethermethylene chloride (1/1) removed impurities. Elution with ether-methylene chloride-methanol (1/1/0.1) removed the product. Evaporation of the solvent gave the product as a yellow foam (0.5 g, 25% yield) mp 54°–58° C.

Anal. for: $C_{14}H_{13}N_3OS_2.\frac{1}{2}H_2O$: Calcd: C, 53.7; H, 4.5; N, 13.4; Found: C, 53.6; H, 4.2; N, 15.2.

EXAMPLES 13 THROUGH 22

A series of photographic single color image transfer elements were prepared having the following layers coated on a clear polyester support. The coatings differed only in the type and level of nucleating agent in the emulsion layer. All values in parentheses are in $g/m^2$ unless indicated otherwise.

1. Gelatin (1.29), magenta dye-releaser D (0.48) and sodium 5-octadecylhydroquinone-2-sulfonate (5 g/mole Ag). Dye releaser D is Compound XVI in Fernandez U.S. Pat. No. 4,135,929.
2. A green sensitive internal image silver bromide (0.48 Ag) gelatin (1.29) emulsion including sodium 5-octadecylhydroquinone-2-sulfonate (6 g/m Ag), 5-acetyl-2-benzyloxycarbonylthio-4-methylthiazole (100 mg/m Ag) and Compound K ($1.15\times10^{-4}$ mole/mole Ag).
3. An overcoat layer of gelatin (1.29), didodecyl hydroquinone (0.22), developing agent Compound 44 of U.S. Pat. No. 4,358,525 (0.52) and bis(vinylsulfonyl)methane hardener (1%).

The elements were exposed (500 W, 3200° K.+W99 filter) for five seconds through a multicolor graduated density test object and soaked for 15 seconds at 28° C. in an activator solution containing the following components:

| Components | g/l |
|---|---|
| 5-Methylbenzotriazole | 3.0 |
| 11-Aminoundecanoic acid | 2.0 |
| Potassium bromide | 2.0 |
| Made up to 1 liter with 0.6 N potassium hydroxide | |

After soaking, the element was laminated to a dye image receiver (structure given below) for 4 minutes at ~21.0° C. and then peeled apart. The receiver was washed with distilled water, air dried, and read on a densitometer.

The dye image receiver of the following structure was prepared as follows; coverages are in $g/m^2$:

4. Gelatin overcoat layer (0.65) containing zinc sulfate (90.04)
3. Interlayer of 2-(2-hydroxy-3,5-di-t-amylphenyl)benzotriazole (0.54) in gelatin (0.86)
2. Image receiving layer: Mordant:poly(styrene-co-1-vinylimidazole-co-3-(2-hydroxyethyl)-2-vinylimidazolium chloride), weight ratio 50:40:10 (2.4), sorbitol (0.54), gelatin (3.0)
1. Gelatin (0.81), plus formaldehyde equal to 1.25% of the total gelatin weight Coated on opaque paper stock.

Listed below in Table II are data which compare the relative nucleating activity of other compounds with nucleating agent Compound K. The activity rating value is based upon the concentration of nucleating agent that is required to give an equivalent H and D curve; i.e., similar D-max, contrast, speed, and D-min as nucleating agent Compound K.

With Compound K assigned an activity rating of 1.0, a nucleating agent with a rating of 2.0 is twice as active, i.e., only one-half the concentration of nucleating agent on a molar basis is required to give the same relative curve shape as Compound K.

TABLE II

| Compound | Molar Reactivity Relative to K |
|---|---|
| A | 3.14 |
| B | 3.14 |
| C | 1.43 |
| D | 2.86 |
| E | 0.71 |
| F | 0.71 |
| G | 0.71 |
| H* | Inactive |
| I* | Inactive |
| J* | Inactive |
| K | 1.0 |
| L* | 0.28 |
| O** | 0.44 |

*These compounds do not form a part of the invention. Refer to Table I to compare structural similarities.

**O—ethyl-N—{4-[2-formyl-1-(4-methylphenylsulfonyl)hydrazino]phenyl}thiocarbamate. This compound, preparation described below, satisfies the requirements of this invention, but has been further modified by the incorporation of a sulfonyl substituent to the hydrazino moiety as specifically taught by Hess et al, cited above. Because of the methylphenylsulfonyl substituent, the compound shows higher activity at a lower pH than employed in this example.

EXAMPLES 23 THROUGH 25

These examples illustrate that activity of the compounds as a function of temperature can be controlled by variation in the pattern of substitution.

The materials described above in connection with Examples 15 through 22 containing Compounds E, F, and G were again prepared.

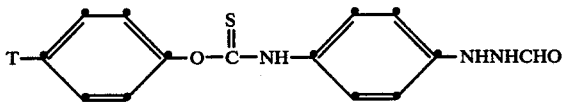

| | |
|---|---|
| T = —$OCH_3$ | Compound F |
| T = —H | Compound E |
| T = —Cl | Compound G |

These compounds were examined at soak and laminate temperatures of 18.3° C., 23.9° C., and 29.4° C. Compound F gave increased developability with increasing temperature; Compound G gave decreasing developability with increasing temperature (inverse temperature sensitivity) and Compound E showed intermediate behavior.

The following illustrates compounds according to this invention which also contain a sulfonyl substituent to the hydrazino moiety, which is the specific subject matter of Hess et al, cited above:

EXAMPLE 26

Preparation of O-ethyl-N-{4-[2-formyl-1-(4-methylphenylsulfonyl)hydrazino]phenyl} thiocarbamate (Compound O)

1-(4-Aminophenyl)-2-formyl-2-(4-methylphenylsulfonyl)hydrazine (2.0 g, 6.5 mmole) was added to dry acetonitrile (50 ml) under nitrogen with stirring and cooled in an ice bath. Thiocarbonyldiimidazole (1.4 g, 7.8 mmole) was added in portions as a solid. The reaction mixture was stirred for 30 minutes at ice bath temperatures and then for 1 hour at room temperature. After concentrating the reaction mixture by evaporation, the oily residue was slurried with water. After decanting the water, the oil was dissolved in ethanol (50 ml) and refluxed for approximately 15 hours. The solvent was evaporated and the residue was purified by column chromatography on silica gel. Elution with methylene chloride removed the by-products. Subsequent elution with ether gave a product which crystallized out of the ether fractions. This solid was collected by filtration and dried; yield 0.32 g (12 percent), m.p. 179.5°-180.5° C.

Anal. for: $C_{17}H_{19}N_3O_4S_2$: Calcd: C, 51.9; H, 4.9; N, 10.7; Found: C, 52.3; H, 5.1; N, 10.7.

EXAMPLE 27

Control Coating

A 0.75 μm, octahedral, core/shell emulsion internally sensitized with sulfur plus gold and surface sensitized with sulfur was coated on a film support at 4.09 g Ag/m$^2$ and 5.81 g gel/m$^2$ with a gelatin overcoat layer (0.65 g/m$^2$) as a control coating. The dried coating was exposed for 2 sec/500W 5500° K. through a graduated density step wedge and processed (30 sec/21.1° C.) in a Phenidone® (1-phenyl-3-pyrazolidone)-hydroquinone developer.

Example Coating

This coating was like the control coating, but also contained Compound O at 0.15 mmole/mole Ag. The results are in Table III

TABLE III

| Compound | Reversal D-max | Reversal D-min |
|---|---|---|
| None | 0.07 | 0.06 |
| O | 2.02 | 0.07 |

The invention has been described in detail with particular reference to preferred embodiments thereof, but it will be understood that variations and modifications can be effected within the spirit and scope of the invention.

What is claimed is:

1. A radiation-sensitive silver halide emulsion comprised of a dispersing medium, silver halide grains, and, adsorbed to the surface of said silver halide grains, an arylhydrazide containing, bonded directly to an aryl substituent of an N,N'-hydrazino moiety thereof, an acyclic oxythioamido adsorption promoting moiety of the formula:

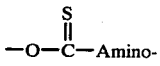

where Amino is a secondary or tertiary amino group, provided that Amino is a secondary amino group when —O— and Amino are both directly bonded to aromatic rings, wherein, when said silver halide grains are capable of forming a surface latent image, said arylhydrazide is present in a speed increasing amount, and when said silver halide grains are capable of forming an internal latent image, said arylhydrazide is present in an amount sufficient to promote development of unexposed silver halide grains in a surface developer.

2. A radiation-sensitive silver halide emulsion according to claim 1 wherein said silver halide grains are capable of forming a surface latent image and said arylhydrazide is present in a speed increasing amount.

3. A radiation-sensitive silver halide emulsion according to claim 1 wherein said silver halide grains are capable of forming an internal latent image and said arylhydrazide is present in an amount sufficient to promote development of unexposed silver halide grains in a surface developer.

4. A radiation-sensitive silver halide emulsion according to claim 1 wherein said arylhydrazide is present in a concentration of up to $10^{-2}$ mole per mole of silver.

5. A radiation-sensitive silver halide emulsion according to claim 4 wherein said arylhydrazide is present in a concentration of up to $10^{-3}$ mole per mole of silver.

6. A radiation-sensitive emulsion comprised of a dispersing medium, silver halide grains, and, adsorbed to said silver halide grains, an arylhydrazide of the formula:

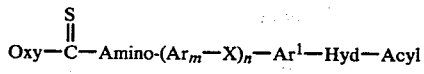

where

Oxy is an oxy group;

Amino is a secondary or tertiary amino group;

Ar and Ar' are arylene groups;

X is an aliphatic divalent linking group;

m or n is 0 or 1;

Hyd is N,N'-hydrazino; and

Acyl is an acyl group;

with the proviso that Amino is a secondary amino group when Oxy is an aryloxy group and Amino is bonded directly to Ar or Ar$^1$, wherein, when said silver halide grains are capable of forming a surface latent image, said arylhydrazide is present in a speed increasing amount and when said silver halide grains are capable of forming an internal latent image, said arylhydrazide is present in an amount sufficient to promote development of unexposed silver halide grains in a surface developer.

7. A radiation-sensitive emulsion according to claim 6 wherein said Oxy group is chosen to donate electrons to said —C(S)— group, thereby increasing the activity of said arylhydrazide as a function of increasing temperature.

8. A radiation-sensitive emulsion according to claim 7 additionally including an arylhydrazide which decreases in activity as a function of increasing temperature.

9. A radiation-sensitive emulsion according to claim 6 wherein said Oxy group is chosen to withdraw electrons from said —C(S)— group, thereby decreasing the activity of said arylhydrazide as a function of increasing temperature.

10. A radiation-sensitive emulsion according to claim 9 additionally including an arylhydrazide which increases in activity as a function of increasing temperature.

11. A radiation-sensitive emulsion according to claim 6 wherein said arylhydrazide is of the formula:

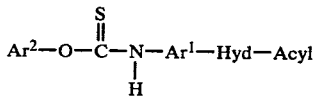

where $Ar^1$ and $Ar^2$ are arylene and aryl groups, respectively;

Hyd is N,N'-hydrazino; and

Acyl is an acyl group.

12. A radiation-sensitive emulsion according to claim 11 wherein $Ar^2$ is a phenyl nucleus, $Ar^1$ is a phenylene group, and Acyl is a $—C(O)R^1$ group where $R^1$ is hydrogen, an alkyl substituent having from 1 to 8 carbon atoms, or a phenyl nucleus.

13. A radiation-sensitive emulsion according to claim 6 wherein said arylhydrazide is of the formula:

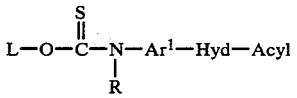

where

L is an alkyl substituent;

R is hydrogen or a benzyl substituent;

$Ar^1$ is arylene;

Hyd is N,N'-hydrazino; and

Acyl is an acyl group.

14. A radiation sensitive emulsion according to claim 13 in which R is hydrogen.

15. A radiation sensitive emulsion according to claim 13 in which R is a benzyl substituent.

16. A radiation sensitive emulsion according to claim 15 in which R is benzyl, alkylbenzyl, alkoxybenzyl, or halobenzyl.

17. A radiation-sensitive emulsion according to claim 16 wherein L includes a ballasting moiety.

18. A radiation-sensitive emulsion according to claim 13 wherein L is an alkyl substituent of from 1 to 8 carbon atoms; R is hydrogen, benzyl, halobenzyl, alkylbenzyl, or alkoxybenzyl; $Ar^1$ is phenylene; and Acyl is $—C(O)R^1$ where $R^1$ is hydrogen, an alkyl substituent of from 1 to 6 carbon atoms, or a phenyl nucleus.

19. A photographic element comprised of a support and at least one layer of a silver halide emulsion according to claim 1.

20. A negative working photographic element comprised of a support and one or more silver halide emulsion layers of intermediate or lower contrast, at least one of said emulsion layers being comprised of a silver halide emulsion according to claim 2.

21. A negative working photographic element according to claim 20 additionally including dye image providing means.

22. In a negative working photographic element of intermediate or lower contrast comprised of a support and one or more silver halide emulsion layers, at least one of said emulsion layers being comprised of a dispersing medium and gold sensitized silver halide grains, the improvement comprising adsorbed to the surface of said gold sensitized silver halide grains in a speed increasing amount an arylhydrazide of the formula:

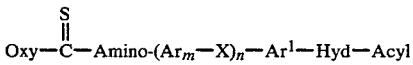

where

Oxy is an oxy group;

Amino is a secondary or tertiary amino group;

Ar and $Ar^1$ are arylene groups;

X is an aliphatic divalent linking group;

m or n is 0 or 1;

Hyd is N,N'-hydrazino; and

Acyl is an acyl group;

with the proviso that Amino is a secondary amino group when Oxy is an aryloxy group and Amino is bonded directly to Ar or $Ar^1$.

23. A negative working photographic element according to claim 22 wherein said Oxy group is an aryloxy group or an alkoxy substituent and n is 0.

24. A negative working photographic element according to claim 23 wherein said Oxy group is a phenoxy nucleus or an alkoxy substituent of from 1 to 8 carbon atoms, $Ar^1$ is a phenylene group, and Acyl is a $—C(O)R^1$ group where $R^1$ is hydrogen, an alkyl substituent having from 1 to 8 carbon atoms, or a phenyl nucleus.

25. A negative working photographic element according to claim 24 wherein $R^1$ is hydrogen, alkyl of from 1 to 3 carbon atoms, or phenyl.

26. A direct positive photographic element comprised of a support and one or more silver halide emulsion layers, at least one of said emulsion layers being comprised of a silver halide emulsion according to claim 3.

27. In a black-and-white silver image forming direct positive photogaphic elment comprised of a support and one or more silver halide emulsion layers comprised of a dispersing medium, internal latent image forming silver halide grains, and, adsorbed to the surface of said silver halide grains in an amount sufficient to promote development of unexposed silver halide grains in a surface developer, an arylhydrazide nucleating agent, the improvement wherein said arylhydrazide nucleating agent is of the formula:

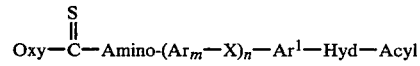

where

Oxy is an oxy group;

Amino is a secondary or tertiary amino group;

Ar and $Ar^1$ are arylene groups;

X is an aliphatic divalent linking group;

m or n is 0 or 1;

Hyd is N,N'-hydrazino; and

Acyl is an acyl group;

with the proviso that Amino is a secondary amino group when Oxy is an aryloxy group and Amino is bonded directly to Ar or $Ar^1$.

28. A black and white silver image forming direct positive photographic element according to claim 27 wherein said Oxy group is an aryloxy group or an alkoxy substituent and n is 0.

29. A black and white silver image forming direct positive photographic element according to claim 28 wherein said Oxy group is a phenoxy nucleus or an alkoxy substituent of from 1 to 8 carbon atoms, $Ar^1$ is a phenylene group, and Acyl is a $—C(O)R^1$ group where $R^1$ is hydrogen, an alkyl substituent having from 1 to 8 carbon atoms, or a phenyl nucleus.

30. A black and white silver image forming direct positive photographic element according to claim 29 wherein $R^1$ is hydrogen, alkyl of from 1 to 3 carbon atoms, or phenyl.

31. In a photographic image transfer film unit comprising a support, at least one emulsion layer located on said support containing a dispersing medium, radiation-sensitive internal latent image forming silver halide grains and an arylhydrazide nucleating agent present in an amount sufficient to promote development of unexposed silver halide grains in a surface developer, a dye image providing material present in said emulsion layer or a layer adjacent thereto, and a receiving layer for providing a viewable transferred dye image following imagewise exposure and processing of said emulsion layer, the improvement comprising said arylhydrazide nucleating agent being of the formula:

$$\text{Oxy}-\overset{\overset{\text{S}}{\|}}{\text{C}}-\text{Amino-}(\text{Ar}_m-\text{X})_n-\text{Ar}^1-\text{Hyd}-\text{Acyl}$$

where

Oxy is an oxy group;

Amino is a secondary or tertiary amino group;

Ar and $Ar^1$ are arylene groups;

X is an aliphatic divalent linking group;

m or n is 0 or 1;

Hyd is N,N'-hydrazino; and

Acyl is an acyl group;

with the proviso that Amino is a secondary amino group when Oxy is an aryloxy group and Amino is bonded directly to Ar or $Ar^1$.

32. A photographic image transfer film unit according to claim 31 wherein said Oxy group is an aryloxy group or an alkoxy substituent and n is 0.

33. A photographic image transfer film unit according to claim 32 wherein said Oxy group is a phenoxy nucleus or an alkoxy substituent of from 1 to 8 carbon atoms, $Ar^1$ is a phenylene group, and Acyl is a —C(O)$R^1$ group where $R^1$ is hydrogen, an alkyl substituent having from 1 to 8 carbon atoms, or a phenyl nucleus.

34. A photographic image transfer film unit according to claim 33 wherein $R^1$ is hydrogen, alkyl of from 1 to 3 carbon atoms, or phenyl.

* * * * *